US010678172B2

(12) United States Patent
Someya et al.

(10) Patent No.: US 10,678,172 B2
(45) Date of Patent: Jun. 9, 2020

(54) HEATING DEVICE, FIXING DEVICE, AND IMAGE FORMING APPARATUS

(71) Applicants: Yukimichi Someya, Saitama (JP); Tomoya Adachi, Kanagawa (JP); Yuusuke Furuichi, Kanagawa (JP)

(72) Inventors: Yukimichi Someya, Saitama (JP); Tomoya Adachi, Kanagawa (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/276,807

(22) Filed: Feb. 15, 2019

(65) Prior Publication Data

US 2019/0286027 A1 Sep. 19, 2019

(30) Foreign Application Priority Data

Mar. 19, 2018 (JP) ..... 2018-050477

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2039; G03G 15/2046; G03G 15/2053; G03G 2215/2003
See application file for complete search history.

(56) References Cited

U.S. PATENT DOCUMENTS 6,469,279 B1 * 10/2002 Ohtsuka ..... G03G 15/2064 219/216

FOREIGN PATENT DOCUMENTS

| | | |
|---|---|---|
| JP | 2008-140701 | 6/2008 |
| JP | 2010-218893 | 9/2010 |
| JP | 2017-173581 | 9/2017 |
| JP | 2018-017877 | 2/2018 |

OTHER PUBLICATIONS

JP 2010218893 English machine translation, Watanabe, Sep. 30, 2010 (Year: 2010).*

* cited by examiner

*Primary Examiner* — Thomas S Giampaolo, II
(74) *Attorney, Agent, or Firm* — Harness, Dickey and Pierce, P.L.C.

(57) ABSTRACT

A heating device includes a belt that rotates in a rotation direction and has a temperature decrease span in an axial direction of the belt, where the belt is susceptible to temperature decrease. A resistive heat generator is disposed opposite the belt. The resistive heat generator heats the belt and extends in the axial direction of the belt. The resistive heat generator includes a primary heat generating portion that generates heat in a first heat generation amount and a secondary heat generating portion that is disposed outside the primary heat generating portion and disposed opposite the temperature decrease span of the belt. The secondary heat generating portion generates heat in a second heat generation amount that is greater than the first heat generation amount of the primary heat generating portion.

18 Claims, 17 Drawing Sheets

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-050477, filed on Mar. 19, 2018, in the Japan Patent Office, the entire disclosure of which is hereby incorporated by reference herein.

BACKGROUND

Technical Field

Exemplary aspects of the present disclosure relate to a heating device, a fixing device, and an image forming apparatus, and more particularly, to a heating device including a resistive heat generator, a fixing device incorporating the heating device, and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ fixing devices of various types to fix the image on the recording medium. As one example, the fixing device includes a fixing belt that is thin and has a decreased thermal capacity and a heater constructed of a base and a laminated, resistive heat generator. The heater heats the fixing belt. The base of the heater is disposed inside a loop formed by the fixing belt and extends in an axial direction of the fixing belt. The laminated, resistive heat generator is disposed on the base. The laminated, resistive heat generator heats an inner circumferential surface of the fixing belt that passes through a fixing nip. The inner circumferential surface of the fixing belt slides over a guide rib that improves stability in rotation of the fixing belt. A surface of the fixing belt slides over a temperature sensor or the like that measures the temperature of the fixing belt.

The fixing belt is thin and has the decreased thermal capacity to facilitate quick startup of the fixing belt and save energy. Accordingly, the guide rib and the temperature sensor draw heat from slide portions of the fixing belt, which slide over the guide rib and the temperature sensor, respectively. Consequently, the slide portions of the fixing belt are susceptible to temperature decrease compared to other portion of the fixing belt. Local temperature decrease of the fixing belt may vary the temperature of the fixing belt in the axial direction thereof, causing faulty fixing and variation in gloss of the image formed on the recording medium easily.

SUMMARY

This specification describes below an improved heating device. In one embodiment, the heating device includes a belt that rotates in a rotation direction and has a temperature decrease span in an axial direction of the belt, where the belt is susceptible to temperature decrease. A resistive heat generator is disposed opposite the belt. The resistive heat generator heats the belt and extends in the axial direction of the belt. The resistive heat generator includes a primary heat generating portion that generates heat in a first heat generation amount and a secondary heat generating portion that is disposed outside the primary heat generating portion and disposed opposite the temperature decrease span of the belt. The secondary heat generating portion generates heat in a second heat generation amount that is greater than the first heat generation amount of the primary heat generating portion.

This specification further describes an improved fixing device. In one embodiment, the fixing device includes a belt that rotates in a rotation direction and has a temperature decrease span in an axial direction of the belt, where the belt is susceptible to temperature decrease. A pressure rotator presses against the belt to form a fixing nip between the belt and the pressure rotator, through which a recording medium bearing an image is conveyed. A resistive heat generator is disposed opposite the belt. The resistive heat generator heats the belt and extends in the axial direction of the belt. The resistive heat generator includes a primary heat generating portion that generates heat in a first heat generation amount and a secondary heat generating portion that is disposed outside the primary heat generating portion and disposed opposite the temperature decrease span of the belt. The secondary heat generating portion generates heat in a second heat generation amount that is greater than the first heat generation amount of the primary heat generating portion.

This specification further describes an improved image forming apparatus. In one embodiment, the image forming apparatus includes an image forming device that forms an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1A:
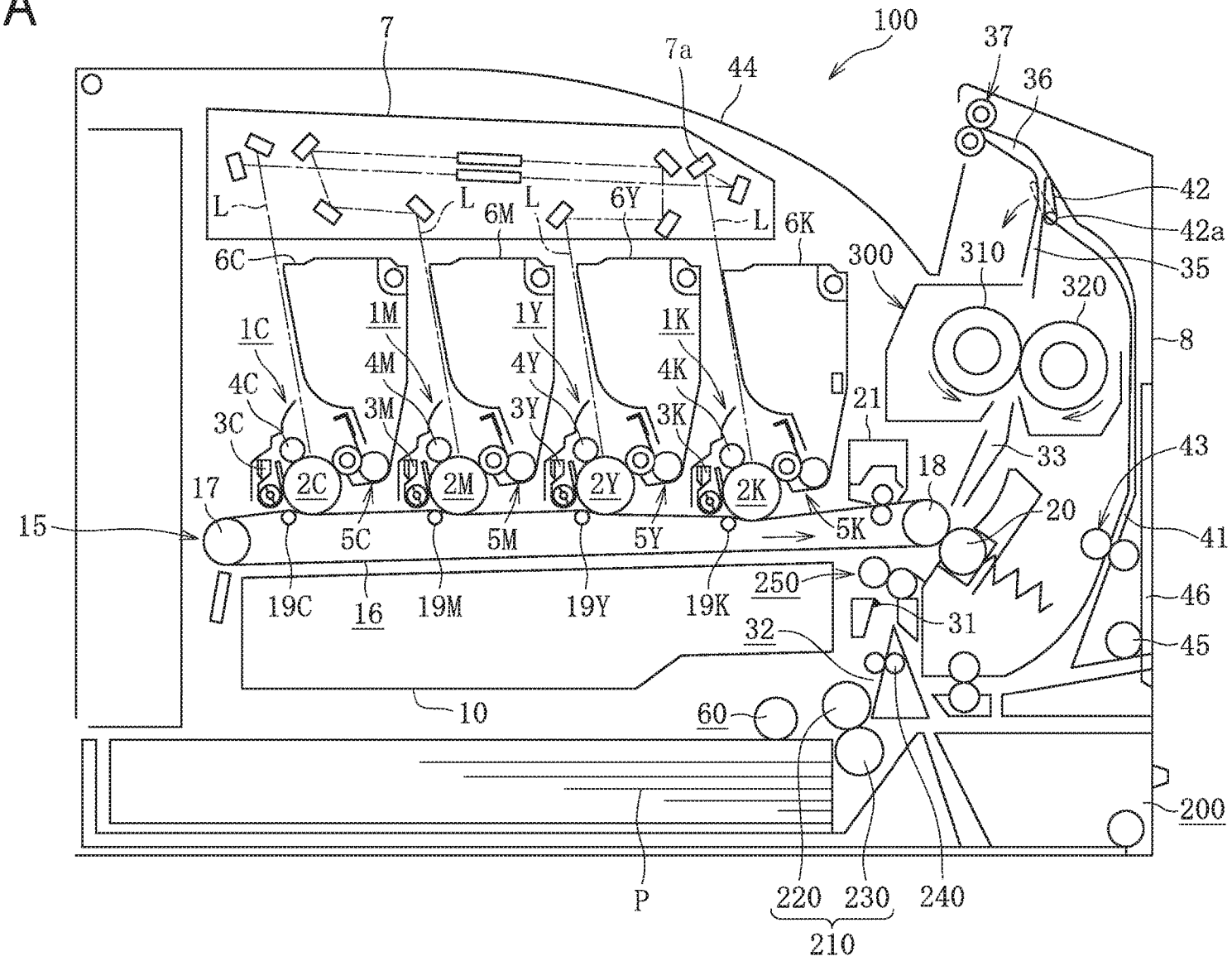
FIG. 1A is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1A, an image forming apparatus 100 is explained.

The image forming apparatus 100 may be a copier, a facsimile machine, a printer, a multifunction peripheral or a multifunction printer (MFP) having at least two of copying, printing, scanning, facsimile, plotter, and other functions, or the like. According to this embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

Referring to drawings, a description is provided of a construction of a heating device, a fixing device incorporating the heating device, and an image forming apparatus (e.g., a laser printer) incorporating the fixing device according to embodiments of the present disclosure.

A laser printer is one example of the image forming apparatus. The image forming apparatus is not limited to the laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium. However, the recording medium is not limited to paper as the sheet. In addition to paper as the sheet, the recording medium includes an OHP (overhead projector) transparency, cloth, a metal sheet, plastic film, and a prepreg sheet pre-impregnated with resin in carbon fiber.

The recording medium also includes a medium adhered with a developer and ink, recording paper, and a recording sheet. The sheet includes plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of a construction of a laser printer as the image forming apparatus 100.

Figure 1B:
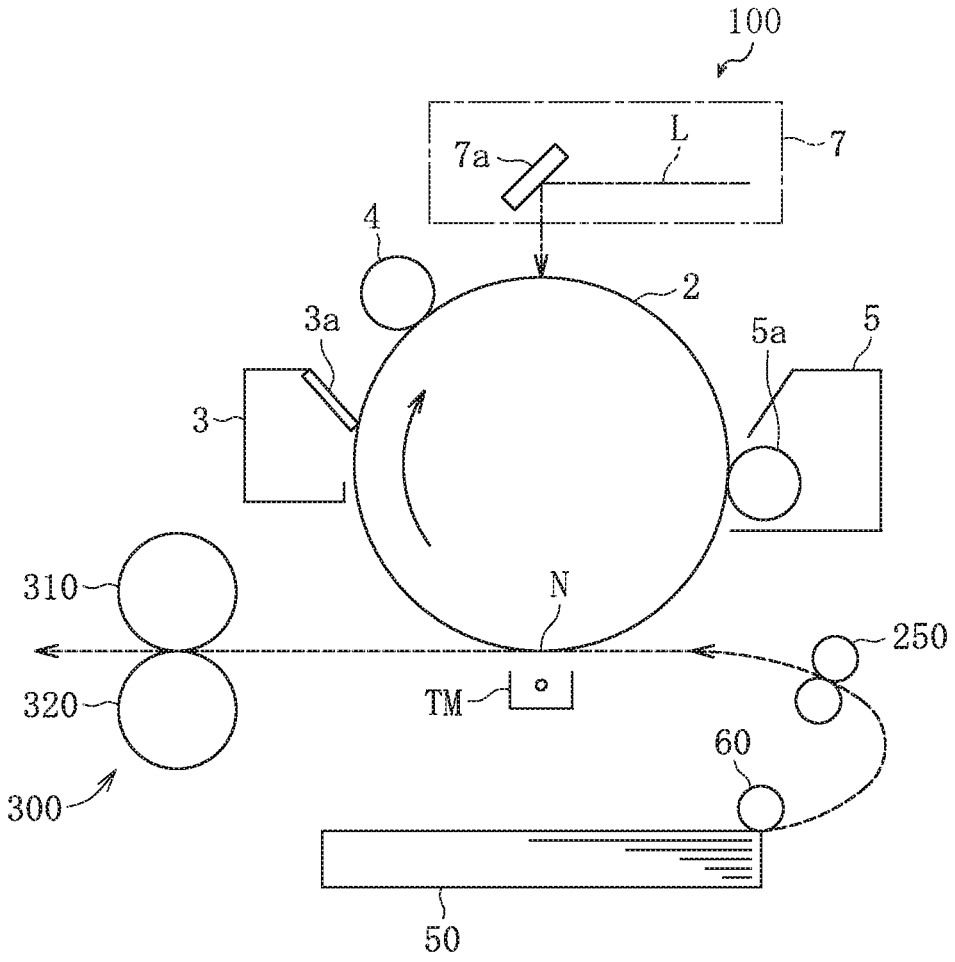
FIG. 1B is a schematic cross-sectional view of the image forming apparatus depicted in FIG. 1A, illustrating a principle thereof.

FIG. 1A is a schematic cross-sectional view of the image forming apparatus 100 that incorporates a fixing device 300 according to the embodiments of the present disclosure. FIG. 1A schematically illustrates a construction of a color laser printer as one embodiment of the image forming apparatus 100. FIG. 1B is a schematic cross-sectional view of the image forming apparatus 100, illustrating and simplifying a principle or a mechanism of the color laser printer.

As illustrated in FIG. 1A, the image forming apparatus 100 includes four process units 1K, 1Y, 1M, and 1C serving as image forming devices, respectively. The process units 1K, 1Y, 1M, and 1C form black, yellow, magenta, and cyan toner images with developers in black (K), yellow (Y), magenta (M), and cyan (C), respectively, which correspond to color separation components for a color image.

The process units 1K, 1Y, 1M, and 1C have a common construction except that the process units 1K, 1Y, 1M, and 1C include toner bottles 6K, 6Y, 6M, and 6C containing fresh toners in different colors, respectively. Hence, the following describes a construction of a single process unit, that is, the process unit 1K, and a description of a construction of each of other process units, that is, the process units 1Y 1M, and 1C, is omitted.

The process unit 1K includes an image bearer 2K (e.g., a photoconductive drum), a drum cleaner 3K, and a discharger. The process unit 1K further includes a charger 4K and a developing device 5K. The charger 4K serves as a charging member or a charging device that uniformly charges a surface of the image bearer 2K. The developing device 5K serves as a developing member that develops an electrostatic latent image formed on the image bearer 2K into a visible image. The process unit 1K is detachably attached to a body of the image forming apparatus 100 to replace consumables of the process unit 1K with new ones. Similarly, the process units 1Y, 1M, and 1C include image bearers 2Y, 2M, and 2C, drum cleaners 3Y, 3M, and 3C, chargers 4Y, 4M, and 4C, and developing devices 5Y, 5M, and 5C, respectively. In FIG. 1B, the image bearers 2K, 2Y, 2M, and 2C, the drum cleaners 3K, 3Y, 3M, and 3C, the chargers 4K, 4Y, 4M, and 4C, and the developing devices 5K, 5Y, 5M, and 5C are indicated as an image bearer 2, a drum cleaner 3, a charger 4, and a developing device 5, respectively.

An exposure device 7 is disposed above the process units 1K, 1Y, 1M, and 1C disposed inside the image forming apparatus 100. The exposure device 7 performs scanning and writing according to image data. For example, the exposure device 7 includes a laser diode that emits a laser beam L according to the image data and a mirror 7*a* that reflects the laser beam L to the image bearer 2K so that the laser beam L irradiates the image bearer 2K.

According to this embodiment, a transfer device 15 is disposed below the process units 1K, 1Y, 1M, and 1C. The transfer device 15 is equivalent to a transferor TM depicted in FIG. 1B. Primary transfer rollers 19K, 19Y, 19M, and 19C are disposed opposite the image bearers 2K, 2Y, 2M, and 2C, respectively, and in contact with an intermediate transfer belt 16.

The intermediate transfer belt 16 rotates in a state in which the intermediate transfer belt 16 is looped over the primary transfer rollers 19K, 19Y, 19M, and 19C, a driving roller 18, and a driven roller 17. A secondary transfer roller 20 is disposed opposite the driving roller 18 and in contact with the intermediate transfer belt 16. The image bearers 2K, 2Y, 2M, and 2C serve as primary image bearers that bear black, yellow, magenta, and cyan toner images, respectively. The intermediate transfer belt 16 serves as a secondary image bearer that bears a composite toner image (e.g., a color toner image) formed with the black, yellow, magenta, and cyan toner images.

A belt cleaner 21 is disposed downstream from the secondary transfer roller 20 in a rotation direction of the intermediate transfer belt 16. A cleaning backup roller is disposed opposite the belt cleaner 21 via the intermediate transfer belt 16.

A sheet feeder 200 including a tray 50 depicted in FIG. 1B that loads sheets P is disposed in a lower portion of the image forming apparatus 100. The sheet feeder 200 serves as a recording medium supply that contains a sheaf of sheets P serving as recording media. The sheet feeder 200 is combined with a sheet feeding roller 60 and a roller pair 210, that serve as separation-conveyance members that separate an uppermost sheet P from other sheets P and convey the uppermost sheet P, into a unit.

The sheet feeder 200 is inserted into and removed from the body of the image forming apparatus 100 for replenishment of the sheets P and the like. The sheet feeding roller 60 and the roller pair 210 are disposed above the sheet feeder 200 and convey the uppermost sheet P of the sheaf of sheets P placed in the sheet feeder 200 toward a sheet feeding path 32.

A registration roller pair 250 serving as a conveyer is disposed immediately upstream from the secondary transfer roller 20 in a sheet conveyance direction. The registration roller pair 250 temporarily halts the sheet P sent from the sheet feeder 200. As the registration roller pair 250 temporarily halts the sheet P, the registration roller pair 250 slacks a leading end of the sheet P, correcting skew of the sheet P.

A registration sensor 31 is disposed immediately upstream from the registration roller pair 250 in the sheet conveyance direction. The registration sensor 31 detects passage of the leading end of the sheet P. When a predetermined time period elapses after the registration sensor 31 detects passage of the leading end of the sheet P, the sheet P strikes the registration roller pair 250 and halts temporarily.

Downstream from the sheet feeder 200 in the sheet conveyance direction is a conveying roller 240 that conveys the sheet P conveyed rightward from the roller pair 210 upward. As illustrated in FIG. 1A, the conveying roller 240 conveys the sheet P upward toward the registration roller pair 250.

The roller pair 210 is constructed of a pair of rollers, that is, an upper roller and a lower roller. The roller pair 210 employs a friction reverse roller (FRR) separation system or a friction roller (FR) separation system. According to the FRR separation system, a separating roller (e.g., a reverse roller) is applied with a torque in a predetermined amount in an anti-feeding direction by a driving shaft through a torque limiter. The separating roller is pressed against a feeding roller to form a nip therebetween where the uppermost sheet P is separated from other sheets P. According to the FR separation system, a separating roller (e.g., a friction roller) is supported by a securing shaft via a torque limiter. The separating roller is pressed against a feeding roller to form a nip therebetween where the uppermost sheet P is separated from other sheets P.

According to this embodiment, the roller pair 210 employs the FRR separation system. For example, the roller pair 210 includes a feeding roller 220 and a separating roller 230. The feeding roller 220 is an upper roller that conveys the sheet P to an inside of a machine. The separating roller 230 is a lower roller that is applied with a driving force in a direction opposite a rotation direction of the feeding roller 220 by a driving shaft through a torque limiter.

A biasing member such as a spring biases the separating roller 230 against the feeding roller 220. The driving force applied to the feeding roller 220 is transmitted to the sheet feeding roller 60 through a clutch, thus rotating the sheet feeding roller 60 counterclockwise in FIG. 1A.

After the leading end of the sheet P strikes the registration roller pair 250 and slacks, the registration roller pair 250 conveys the sheet P to a secondary transfer nip (e.g., a transfer nip N depicted in FIG. 1B) formed between the secondary transfer roller 20 and the intermediate transfer belt 16 at a proper time when the secondary transfer roller 20 transfers a color toner image formed on the intermediate transfer belt 16 onto the sheet P. A bias applied at the secondary transfer nip electrostatically transfers the color toner image formed on the intermediate transfer belt 16 onto a desired transfer position on the sheet P sent to the secondary transfer nip precisely.

A post-transfer conveyance path 33 is disposed above the secondary transfer nip formed between the secondary transfer roller 20 and the intermediate transfer belt 16. The fixing device 300 is disposed in proximity to an upper end of the post-transfer conveyance path 33. As described below with reference to FIG. 2A, the fixing device 300, serving as a fixing device according to a first embodiment, includes a fixing belt 310 and a pressure roller 320. The fixing belt 310 serves as a heating belt. The pressure roller 320, serving as a pressure rotator or a pressure member, rotates while the pressure roller 320 contacts the fixing belt 310 with predetermined pressure. The pressure roller 320 serves as a driver that drives and rotates the fixing belt 310. The fixing device 300 has a construction depicted in FIG. 2A. Alternatively, the fixing device 300 may be replaced by a fixing device 300S according to a second embodiment, a fixing device 300T according to a third embodiment, and a fixing device 300U according to a fourth embodiment, that have constructions described below with reference to FIGS. 2B, 2C, and 2D, respectively.

As illustrated in FIG. 1A, a post-fixing conveyance path 35 is disposed above the fixing device 300. At an upper end of the post-fixing conveyance path 35, the post-fixing conveyance path 35 branches to a sheet ejection path 36 and a reverse conveyance path 41. A switcher 42 is disposed at a bifurcation of the post-fixing conveyance path 35. The switcher 42 pivots about a pivot shaft 42*a* as an axis. A sheet ejection roller pair 37 is disposed in proximity to an outlet edge of the sheet ejection path 36.

One end of the reverse conveyance path 41 is at the bifurcation of the post-fixing conveyance path 35. Another end of the reverse conveyance path 41 joins the sheet feeding path 32. A reverse conveyance roller pair 43 is disposed in a middle of the reverse conveyance path 41. A sheet ejection tray 44 is disposed in an upper portion of the image forming apparatus 100. The sheet ejection tray 44 includes a recess directed inward in the image forming apparatus 100.

A powder container 10 (e.g., a toner container) is interposed between the transfer device 15 and the sheet feeder 200. The powder container 10 is detachably attached to the body of the image forming apparatus 100.

The image forming apparatus 100 according to this embodiment secures a predetermined distance from the sheet feeding roller 60 to the secondary transfer roller 20 to convey the sheet P. Hence, the powder container 10 is situated in a dead space produced by the predetermined distance, downsizing the image forming apparatus 100 entirely.

A transfer cover 8 is disposed above the sheet feeder 200 at a front of the image forming apparatus 100 in a drawing direction of the sheet feeder 200. As an operator (e.g., a user and a service engineer) opens the transfer cover 8, the operator inspects an inside of the image forming apparatus 100. The transfer cover 8 mounts a bypass tray 46 and a bypass sheet feeding roller 45 used for a sheet P manually placed on the bypass tray 46 by the operator.

A description is provided of operations of the image forming apparatus 100, that is, the laser printer.

Referring to FIG. 1A, the following describes basic operations of the image forming apparatus 100 according to this embodiment, which has the construction described above to perform image formation.

First, a description is provided of operations of the image forming apparatus 100 to print on one side of a sheet P.

As illustrated in FIG. 1A, the sheet feeding roller 60 rotates according to a sheet feeding signal sent from a controller of the image forming apparatus 100. The sheet feeding roller 60 separates an uppermost sheet P from other sheets P of a sheaf of sheets P loaded in the sheet feeder 200 and feeds the uppermost sheet P to the sheet feeding path 32.

When the leading end of the sheet P sent by the sheet feeding roller 60 and the roller pair 210 reaches a nip of the registration roller pair 250, the registration roller pair 250 slacks the sheet P and halts the sheet P temporarily. The registration roller pair 250 conveys the sheet P to the secondary transfer nip at an optimal time in synchronism with a time when the secondary transfer roller 20 transfers a color toner image formed on the intermediate transfer belt 16 onto the sheet P while the registration roller pair 250 corrects skew of the leading end of the sheet P.

In order to feed a sheaf of sheets P placed on the bypass tray 46, the bypass sheet feeding roller 45 conveys the sheaf of sheets P loaded on the bypass tray 46 one by one from an uppermost sheet P. The sheet P is conveyed through a part of the reverse conveyance path 41 to the nip of the registration roller pair 250. Thereafter, the sheet P is conveyed similarly to the sheet P conveyed from the sheet feeder 200.

The following describes processes for image formation with one process unit, that is, the process unit 1K, and a description of processes for image formation with other process units, that is, the process units 1Y, 1M, and 1C, is omitted. First, the charger 4K uniformly charges the surface of the image bearer 2K at a high electric potential. The exposure device 7 emits a laser beam L that irradiates the surface of the image bearer 2K according to image data.

The electric potential of an irradiated portion on the surface of the image bearer 2K, which is irradiated with the laser beam L, decreases, forming an electrostatic latent image on the image bearer 2K. The developing device 5K includes a developer bearer 5*a* depicted in FIG. 1B that bears a developer containing toner. Fresh black toner supplied from the toner bottle 6K is transferred onto a portion on the surface of the image bearer 2K, which bears the electrostatic latent image, through the developer bearer 5*a*.

The surface of the image bearer 2K transferred with the toner bears a black toner image developed with the black toner. The primary transfer roller 19K transfers the black toner image formed on the image bearer 2K onto the intermediate transfer belt 16.

A cleaning blade 3*a* depicted in FIG. 1B of the drum cleaner 3K removes residual toner failed to be transferred onto the intermediate transfer belt 16 and therefore adhered on the surface of the image bearer 2K therefrom. The removed residual toner is conveyed by a waste toner conveyer and collected into a waste toner container disposed inside the process unit 1K. The discharger removes residual electric charge from the image bearer 2K from which the drum cleaner 3K has removed the residual toner.

Similarly, in the process units 1Y, 1M, and 1C, yellow, magenta, and cyan toner images are formed on the image bearers 2Y, 2M, and 2C, respectively. The primary transfer rollers 19Y, 19M, and 19C transfer the yellow magenta, and cyan toner images formed on the image bearers 2Y, 2M, and 2C, respectively, onto the intermediate transfer belt 16 such that the yellow, magenta, and cyan toner images are superimposed on the intermediate transfer belt 16.

The black, yellow, magenta, and cyan toner images transferred and superimposed on the intermediate transfer belt 16 move to the secondary transfer nip formed between the secondary transfer roller 20 and the intermediate transfer belt 16. On the other hand, the registration roller pair 250 resumes rotation at a predetermined time while sandwiching a sheet P that strikes the registration roller pair 250. The registration roller pair 250 conveys the sheet P to the secondary transfer nip formed between the secondary transfer roller 20 and the intermediate transfer belt 16 at a time when the secondary transfer roller 20 transfers the black, yellow, magenta, and cyan toner images superimposed on the intermediate transfer belt 16 properly. Thus, the secondary transfer roller 20 transfers the black, yellow, magenta, and cyan toner images superimposed on the intermediate transfer belt 16 onto the sheet P conveyed by the registration roller pair 250, forming a color toner image on the sheet P.

The sheet P transferred with the color toner image is conveyed to the fixing device 300 through the post-transfer conveyance path 33. The fixing belt 310 and the pressure roller 320 sandwich the sheet P conveyed to the fixing device 300 and fix the unfixed color toner image on the sheet P under heat and pressure. The sheet P bearing the fixed color toner image is conveyed from the fixing device 300 to the post-fixing conveyance path 35.

When the sheet P is sent out of the fixing device 300, the switcher 42 opens the upper end of the post-fixing conveyance path 35 and a vicinity thereof as illustrated with a solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing printing on one side of the sheet P.

Next, a description is provided of operations of the image forming apparatus 100 to perform duplex printing.

Similarly to printing on one side of the sheet P, the fixing device 300 sends out the sheet P to the sheet ejection path 36. In order to perform duplex printing, the sheet ejection roller pair 37 is driven and rotated to convey a part of the sheet P to an outside of the image forming apparatus 100.

When a trailing end of the sheet P has passed through the sheet ejection path 36, the switcher 42 pivots about the pivot shaft 42*a* as illustrated with a dotted line in FIG. 1A, closing the upper end of the post-fixing conveyance path 35. Approximately simultaneously with closing of the upper end of the post-fixing conveyance path 35, the sheet ejection roller pair 37 rotates in a direction opposite a direction in which the sheet ejection roller pair 37 conveys the sheet P onto the outside of the image forming apparatus 100, thus conveying the sheet P to the reverse conveyance path 41.

The sheet P conveyed to the reverse conveyance path 41 travels to the registration roller pair 250 through the reverse conveyance roller pair 43. The registration roller pair 250 conveys the sheet P to the secondary transfer nip at a proper time when the secondary transfer roller 20 transfers black, yellow, magenta, and cyan toner images superimposed on the intermediate transfer belt 16 onto a back side of the sheet P, which is transferred with no toner image, that is, in synchronism with reaching of the black, yellow, magenta, and cyan toner images to the secondary transfer nip.

While the sheet P passes through the secondary transfer nip, the secondary transfer roller 20 and the driving roller 18 transfer the black, yellow, magenta, and cyan toner images onto the back side of the sheet P, which is transferred with no toner image, thus forming a color toner image on the sheet P. The sheet P transferred with the color toner image is conveyed to the fixing device 300 through the post-transfer conveyance path 33.

In the fixing device 300, the fixing belt 310 and the pressure roller 320 sandwich the sheet P conveyed to the fixing device 300 and fix the unfixed color toner image on the back side of the sheet P under heat and pressure. The sheet P bearing the color toner image fixed on both sides, that is, a front side and the back side, of the sheet P is conveyed from the fixing device 300 to the post-fixing conveyance path 35.

When the sheet P is sent out of the fixing device 300, the switcher 42 opens the upper end of the post-fixing conveyance path 35 and the vicinity thereof as illustrated with the solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing duplex printing on the sheet P.

After the secondary transfer roller 20 transfers the black, yellow, magenta, and cyan toner images superimposed on the intermediate transfer belt 16 onto the sheet P, residual toner adheres to the intermediate transfer belt 16. The belt cleaner 21 removes the residual toner from the intermediate transfer belt 16. The residual toner removed from the intermediate transfer belt 16 is conveyed by the waste toner conveyer and collected into the powder container 10.

A description is provided of a detailed construction of the fixing device 300.

Figure 2A:
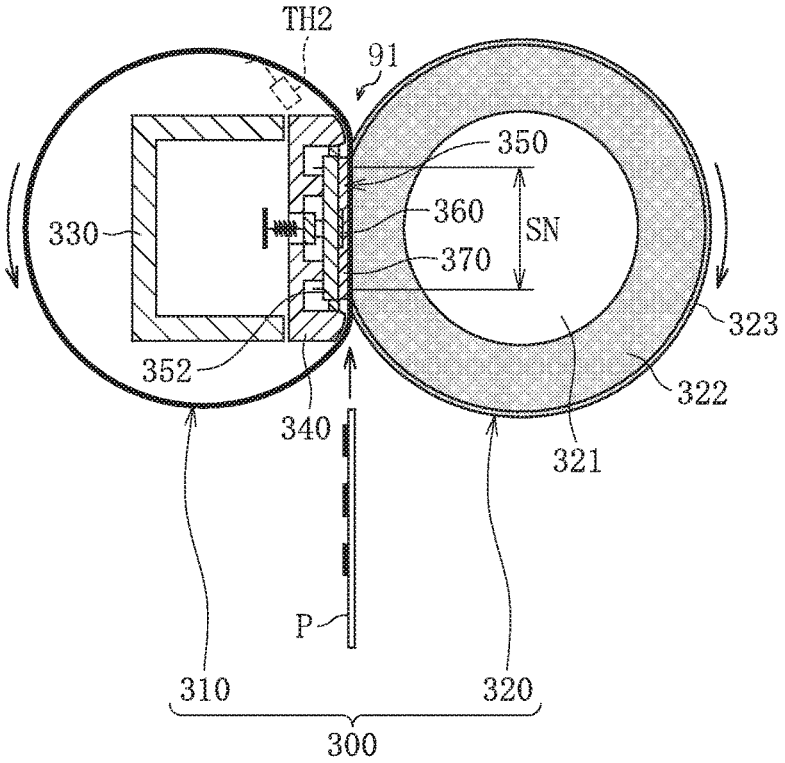
FIG. 2A is a cross-sectional view of a fixing device according to a first embodiment of the present disclosure, that is incorporated in the image forming apparatus depicted in FIG. 1A.

Referring to FIG. 2A illustrating the fixing device 300 according to the first embodiment, the following describes the detailed construction of the fixing device 300 and a heater 350 incorporated therein according to embodiments of the present disclosure.

As illustrated in FIG. 2A, the fixing device 300 according to the first embodiment includes the fixing belt 310 that is thin and has a decreased thermal capacity and the pressure roller 320. For example, the fixing belt 310 includes a tubular base that is made of polyimide (PI) and has an outer diameter of 25 mm and a thickness in a range of from 40 micrometers to 120 micrometers.

The fixing belt 310 includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 310 and facilitate separation of the sheet P and a foreign substance from the fixing belt 310. Optionally, an elastic layer that is made of rubber or the like and has a thickness in a range of from 50 micrometers to 500 micrometers may be interposed between the base and the release layer.

The base of the fixing belt 310 may be made of heat resistant resin such as polyetheretherketone (PEEK) or metal such as nickel (Ni) and SUS stainless steel, instead of polyimide. An inner circumferential surface of the fixing belt 310 may be coated with polyimide, PTFE, or the like to produce a slide layer.

The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has a thickness of 3.5 mm, for example. In order to facilitate separation of the sheet P and the foreign substance from the pressure roller 320, the release layer 323 that is made of fluororesin and has a thickness of about 40 micrometers, for example, is preferably disposed on the outer surface of the elastic layer 322. A biasing member presses the pressure roller 320 against the fixing belt 310.

A description is provided of a configuration of a heater holder 340 incorporated in the fixing device 300.

A stay 330 and the heater holder 340 are disposed inside a loop formed by the fixing belt 310 and extended in an axial direction of the fixing belt 310. The stay 330 includes a channel made of metal. Both lateral ends of the stay 330 in a longitudinal direction thereof are supported by side plates of the fixing device 300, respectively. The stay 330 receives pressure from the pressure roller 320 precisely to form a fixing nip SN stably.

The heater holder 340 holds a base 352 of the heater 350 and is supported by the stay 330. The heater holder 340 is preferably made of heat resistant resin having a decreased thermal conductivity, such as liquid crystal polymer (LCP). Accordingly, the heater holder 340 reduces conduction of heat thereto, improving heating of the fixing belt 310.

In order to prevent contact with a high temperature portion of the base 352, the heater holder 340 has a shape that allows the heater holder 340 to support the base 352 at two positions in proximity to both ends of the base 352 in a short direction thereof. Accordingly, the heater holder 340 reduces conduction of heat thereto further, improving heating of the fixing belt 310.

A description is provided of variations of the fixing device 300.

The fixing device 300 according to the first embodiment depicted in FIG. 2A provides variations thereof.

Figure 2B:
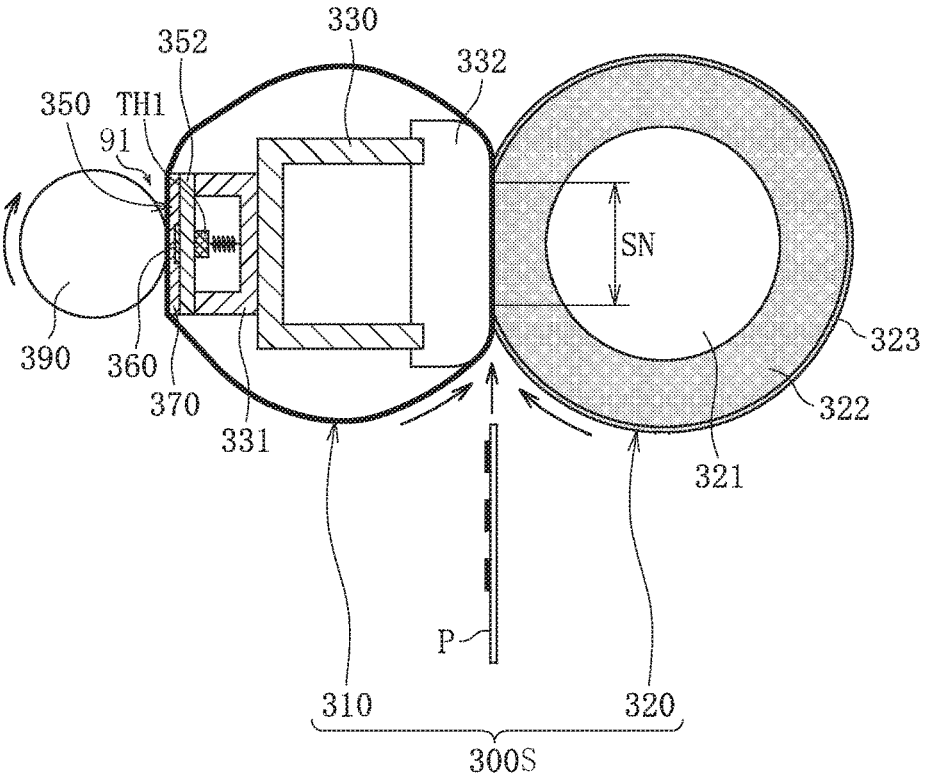
FIG. 2B is a cross-sectional view of a fixing device according to a second embodiment of the present disclosure, that is installable in the image forming apparatus depicted in FIG. 1A.
Figure 2C:
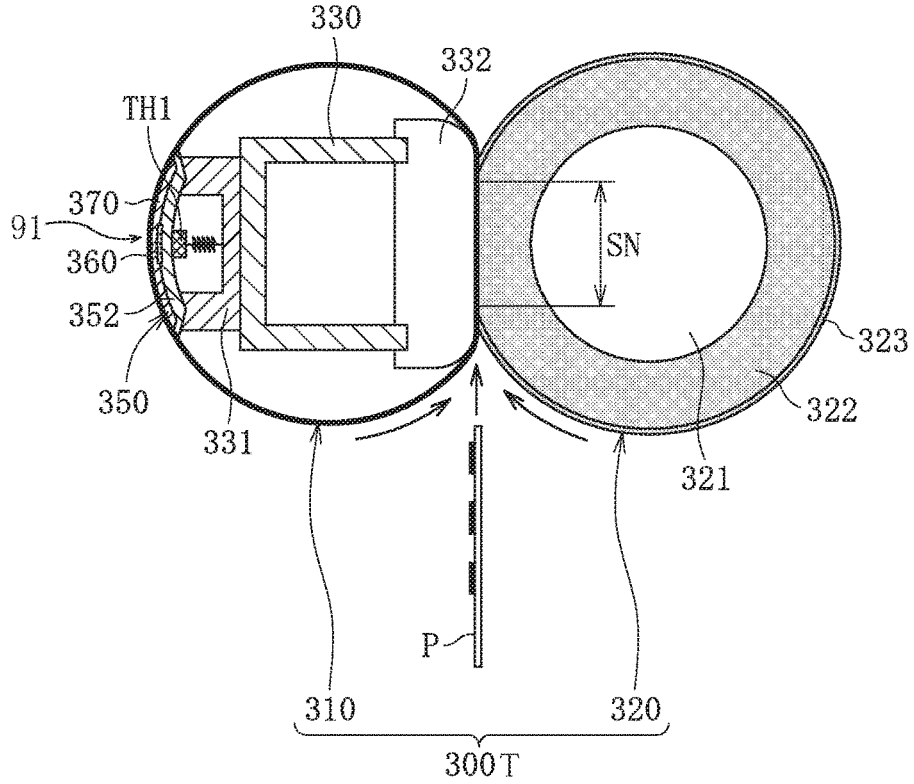
FIG. 2C is a cross-sectional view of a fixing device according to a third embodiment of the present disclosure, that is installable in the image forming apparatus depicted in FIG. 1A.
Figure 2D:
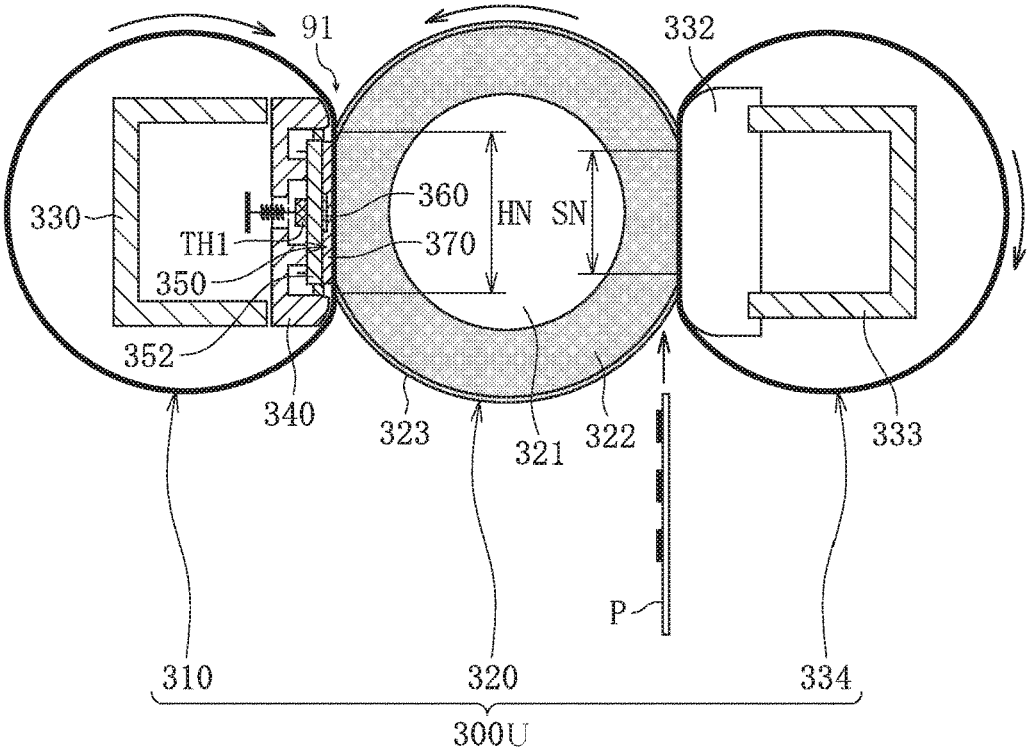
FIG. 2D is a cross-sectional view of a fixing device according to a fourth embodiment of the present disclosure, that is installable in the image forming apparatus depicted in FIG. 1A.

Referring to FIGS. 2B, 2C, and 2D, the following describes a construction of the fixing devices 300S, 300T, and 300U according to the second embodiment, the third embodiment, and the fourth embodiment, respectively.

As illustrated in FIG. 2B, the fixing device 300S according to the second embodiment includes a pressing roller 390 disposed opposite the pressure roller 320 via the fixing belt 310. The pressing roller 390 and the heater 350 sandwich the fixing belt 310 such that the heater 350 heats the fixing belt 310.

The heater 350 is disposed inside the loop formed by the fixing belt 310. A supplementary stay 331 is mounted on a first side of the stay 330. A nip forming pad 332 is mounted on a second side of the stay 330, which is opposite the first side thereof. The heater 350 is supported by the supplementary stay 331. The pressure roller 320 is pressed against the nip forming pad 332 via the fixing belt 310 to form the fixing nip SN between the fixing belt 310 and the pressure roller 320.

As illustrated in FIG. 2C, the fixing device 300T according to the third embodiment includes the heater 350 disposed inside the loop formed by the fixing belt 310. Since the fixing device 300T eliminates the pressing roller 390 depicted in FIG. 2B, in order to increase the length for which the heater 350 contacts the fixing belt 310 in a circumferential direction thereof, the base 352 and an insulating layer 370 of the heater 350 are curved into an arc in cross-section that corresponds to a curvature of the fixing belt 310. A heat generator 360 as a resistive heat generator is disposed at a center of the base 352, that is arc-shaped, in the circumferential direction of the fixing belt 310. Other construction of the fixing device 300T is equivalent to the construction of the fixing device 300S according to the second embodiment depicted in FIG. 2B.

As illustrated in FIG. 2D, the fixing device 300U according to the fourth embodiment defines a heating nip FIN separately from the fixing nip SN. For example, the nip forming pad 332 and a stay 333 that includes a channel made of metal are disposed opposite the fixing belt 310 via the pressure roller 320. A pressure belt 334 that is rotatable accommodates the nip forming pad 332 and the stay 333. As a sheet P bearing a toner image is conveyed through the fixing nip SN formed between the pressure belt 334 and the pressure roller 320, the pressure belt 334 and the pressure roller 320 heat and fix the toner image on the sheet P. Other construction of the fixing device 300U is equivalent to the construction of the fixing device 300 according to the first embodiment depicted in FIG. 2A.

As illustrated in FIG. 2B, a first temperature sensor TH1 used for temperature control is disposed opposite the inner circumferential surface of the fixing belt 310. As illustrated in FIG. 2A with a dotted line, a biasing member may press a second temperature sensor TH2, that is used to ensure safety, against the inner circumferential surface of the fixing belt 310. The second temperature sensor TH2 is disposed as described above with reference to FIG. 2A, rendering it to be less difficult to spare the space for the temperature sensors.

The fixing device 300 includes a heating device 91 that includes the fixing belt 310, the heater holder 340, the heater 350, and the second temperature sensor TH2.

Figure 3A:
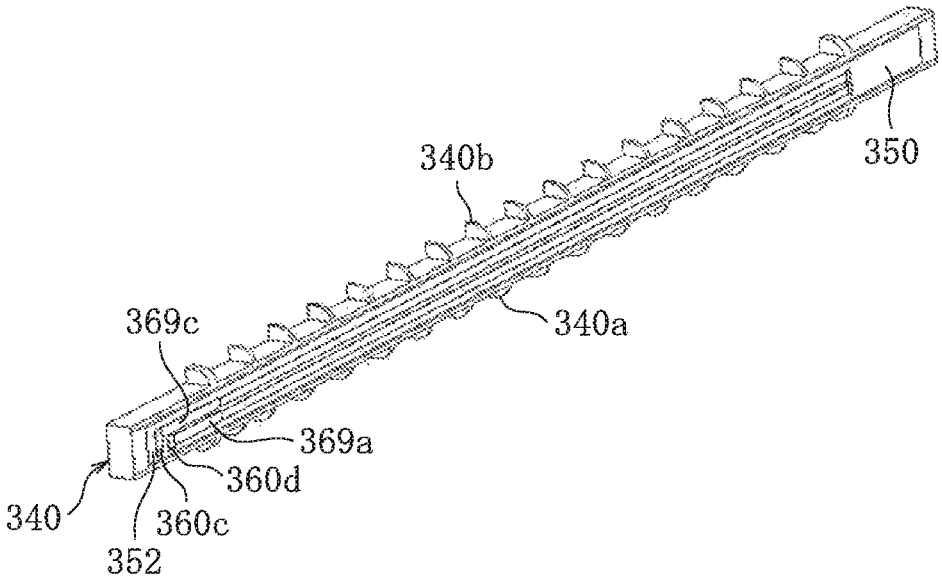
FIG. 3A is a perspective view of a heater and a heater holder incorporated in the fixing device depicted in FIG. 2A.
Figure 3B:
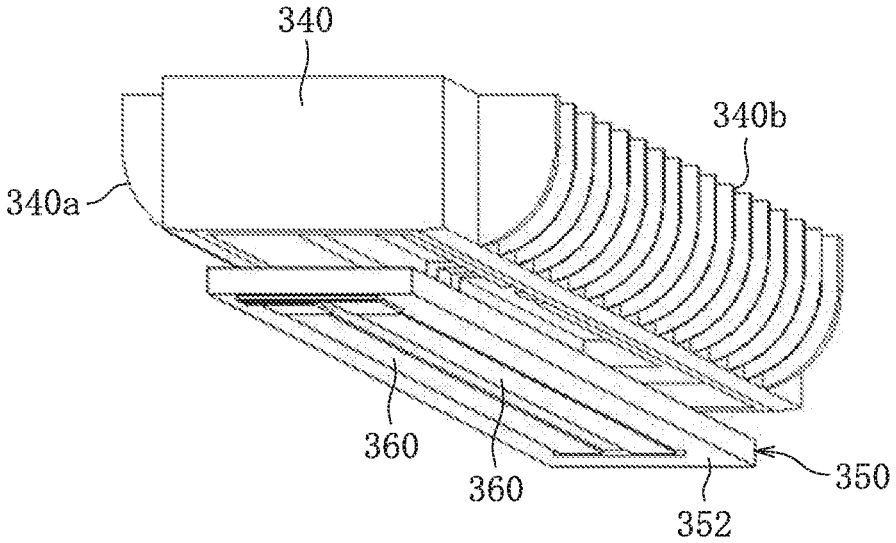
FIG. 3B is an exploded perspective view of the heater and the heater holder depicted in FIG. 3A.
Figure 3C:
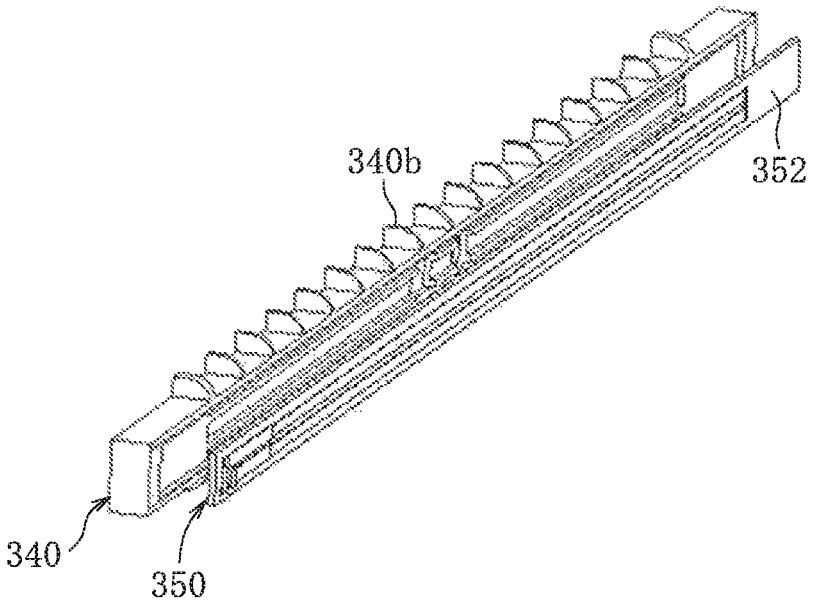
FIG. 3C is another exploded perspective view of the heater and the heater holder depicted in FIG. 3A.
Figure 3D:
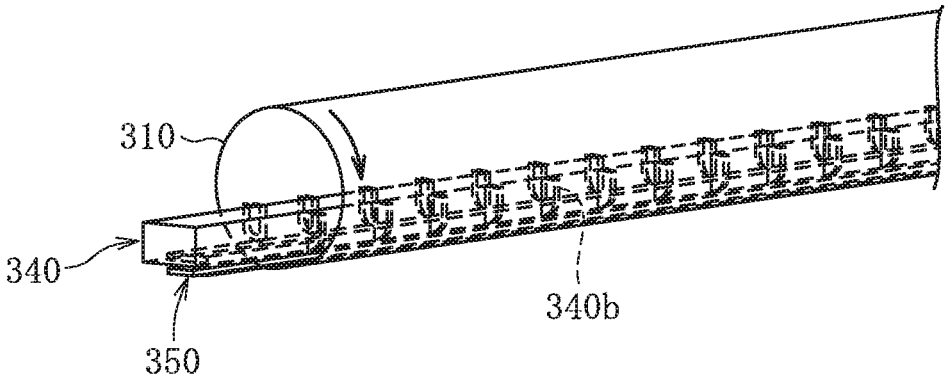
FIG. 3D is a perspective view of the heater holder depicted in FIG. 3A, that is inserted into a fixing belt incorporated in the fixing device depicted in FIG. 2A.
Figure 3E:
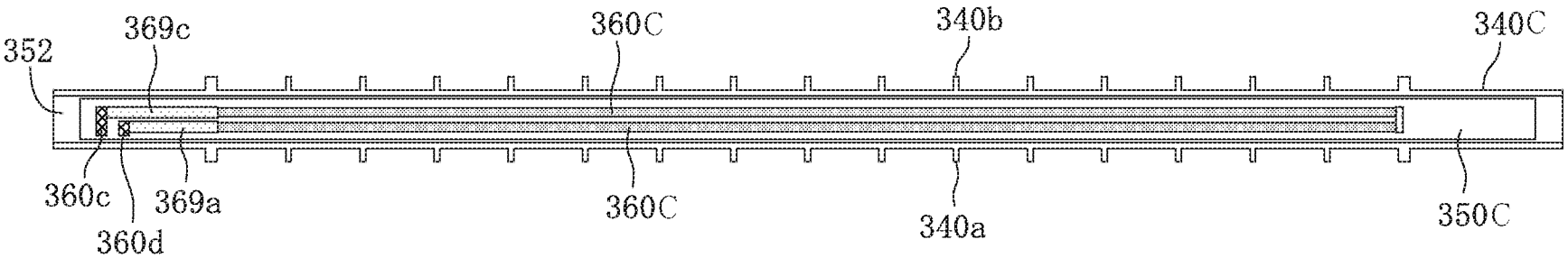
FIG. 3E is a plan view of a heater and a heater holder, illustrating a first comparative arrangement of guide ribs mounted on the heater holder.
Figure 3F:
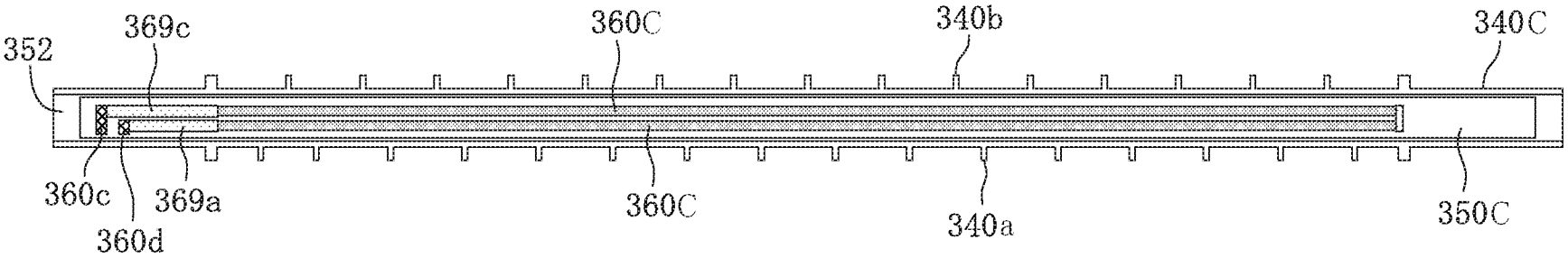
FIG. 3F is a plan view of the heater and the heater holder depicted in FIG. 3E, illustrating a second comparative arrangement of the guide ribs mounted on the heater holder.

FIG. 3A is a perspective view of the heater 350 and the heater holder 340. FIG. 3B is an exploded perspective view of the heater 350 and the heater holder 340. FIG. 3C is another exploded perspective view of the heater 350 and the heater holder 340. FIG. 3D is a perspective view of the heater holder 340 that is inserted into the fixing belt 310. FIG. 3E is a front view of a heater 350C and a heater holder 340C, illustrating a first comparative arrangement of guide ribs 340*a* and 340*b* mounted on the heater holder 340C. FIG. 3F is a front view of the heater 350C and the heater holder 340C, illustrating a second comparative arrangement of the guide ribs 340*a* and 340*b* mounted on the heater holder 340C.

As illustrated in FIGS. 3A, 3B, 3C, 3D, 3E, and 3F, each of the heater holders 340 and 340C is an elongate member that is rectangular in cross-section and extends in a longitudinal direction, that is, the axial direction, of the fixing belt 310. The heater 350 is mounted on a front face of the heater holder 340. The plurality of guide ribs 340*a* and 340*b* is mounted on both faces, that is, an upper face and a lower face, of the heater holder 340, respectively. As the fixing belt 310 rotates in a rotation direction and slides over the guide ribs 340*a* and 340*b*, the guide ribs 340*a* and 340*b* guide the fixing belt 310.

Figure 4A:
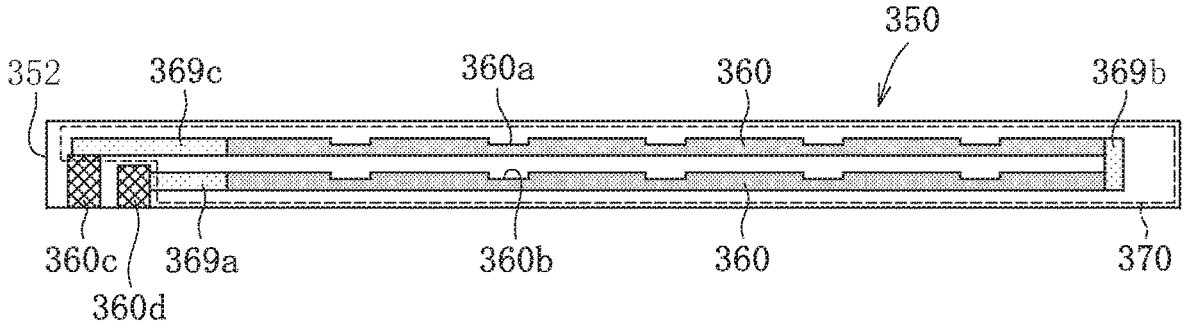
FIG. 4A is a plan view of the heater according to an embodiment of the present disclosure, that is incorporated in the fixing device depicted in FIG. 2A.

Each of the guide ribs 340*a* and 340*b* includes a slide fringe that is arc-shaped and corresponds to a radius of curvature of the inner circumferential surface of the fixing belt 310. An identical interval is provided between adjacent ones of the plurality of guide ribs 340*a* (e.g., 17 guide ribs 340*a* in FIG. 3A) in a longitudinal direction of the heater holder 340. Similarly, an identical interval is provided between adjacent ones of the plurality of guide ribs 340*b* in the longitudinal direction of the heater holder 340. Accordingly, the fixing belt 310 rotates stably while retaining a substantially tubular shape. Recesses 360*a* and 360*b* (e.g., cutout portions) of the heat generator 360 of the heater 350 described below with reference to FIG. 4A are disposed opposite the guide ribs 340*b* and 340*a*, respectively. For example, each of the recesses 360*a* of the heat generator 360 is disposed downstream from the guide rib 340*b* and disposed upstream from the guide rib 340*a* in the rotation direction of the fixing belt 310.

As illustrated in FIG. 3E, the guide ribs 340*b* are disposed upstream from the heater 350C in the rotation direction of the fixing belt 310 and mounted on the upper face of the heater holder 340C. The guide ribs 340*a* are disposed downstream from the heater 350C in the rotation direction of the fixing belt 310 and mounted on the lower face of the heater holder 340C. Each of the guide ribs 340*b* is disposed opposite each of the guide ribs 340*a* at an identical position in a longitudinal direction of the heater holder 340C.

As illustrated in FIG. 3F, each of the guide ribs 340*b* is shifted from each of the guide ribs 340*a* in the longitudinal direction of the heater holder 340C. The guide ribs 340*a* and 340*b* depicted in FIG. 3F are staggered in the longitudinal direction of the heater holder 340C, improving stability in rotation of the fixing belt 310.

A description is provided of a construction of the heater 350.

Figure 4B:
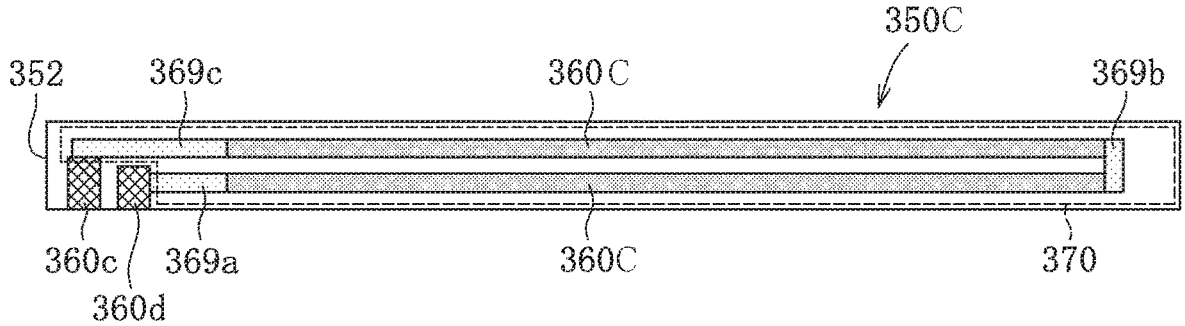
FIG. 4B is a plan view of the heater depicted in FIG. 3E as a comparative example.
Figure 4C:
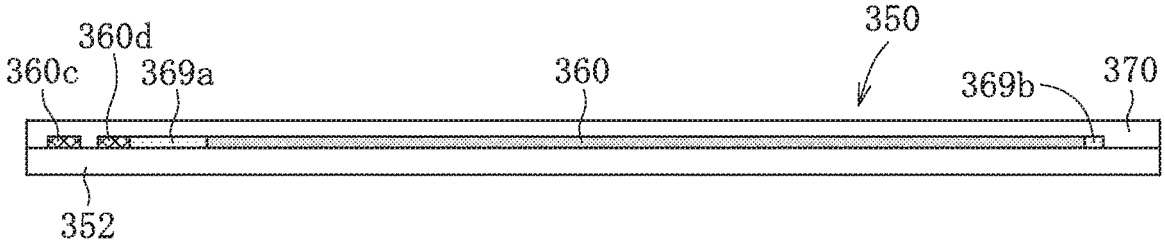
FIG. 4C is a cross-sectional view of the heater depicted in FIG. 4A.

As illustrated in FIG. 2A, the heater 350 is disposed inside the loop formed by the fixing belt 310. The heater 350 is disposed opposite the pressure roller 320 via the fixing belt 310. The heater 350 is disposed opposite the inner circumferential surface of the fixing belt 310 to heat the fixing belt 310. The heat generator 360 as a resistive heat generator is disposed at the center of the base 352 of the heater 350 in the short direction of the base 352. As illustrated in FIGS. 4A, 4B, and 4C, each of the heat generator 360 and a heat generator 360C is mounted on the base 352. The base 352 includes an elongate, thin metal plate and an insulator that coats the metal plate. FIG. 4A is a plan view of the heater 350 according to this embodiment. FIG. 4B is a plan view of the heater 350C as a comparative example. FIG. 4C is a vertical cross-sectional view of the heaters 350 and 350C.

The base 352 is preferably made of aluminum, stainless steel, or the like that is available at reduced costs. Alternatively, instead of metal, the base 352 may be made of ceramic such as alumina and aluminum nitride or a nonmetallic material that has an increased heat resistance and an increased insulation such as glass and mica.

In order to improve evenness of heat generated by the heater 350 so as to enhance quality of an image formed on a sheet P, the base 352 may be made of a material that has an increased thermal conductivity such as copper, graphite, and graphene. According to this embodiment, the base 352 is made of alumina and has a short width of 8 mm, a longitudinal width of 270 mm, and a thickness of 1.0 mm.

As illustrated in FIG. 4A, specifically, the heat generator 360 is mounted on the base 352 and arranged in two lines that are in parallel to each other and extended linearly in a longitudinal direction of the base 352. One end of one line of the heat generator 360 is connected to an electrode 360*c* through a feeder 369*c*. One end of another line of the heat generator 360 is connected to an electrode 360*d* through a feeder 369*a*. The feeders 369*a* and 369*c*, having a decreased resistance value, are disposed on one end of the base 352 and extended in the longitudinal direction of the base 352. The electrodes 360*c* and 360*d* supply power to the two lines of the heat generator 360, respectively. The electrodes 360*c* and 360*d* are coupled to a power supply including an alternating current power supply 410 described below with reference to FIG. 5.

Another end of one line of the heat generator 360 is connected to another end of another line of the heat generator 360 through a feeder 369*b* such that one line of the heat generator 360, that is directed to the feeder 369*b* in the longitudinal direction of the base 352, is turned at the feeder 369*b* and another line of the heat generator 360 is directed in an opposite direction. The feeder 369*b*, having a decreased resistance value, is disposed on another end of the base 352 and extended in the short direction of the base 352. Each of the heat generator 360, the electrodes 360*c* and 360*d*, and the feeders 369*a*, 369*b*, and 369*c* is produced by screen printing to have a predetermined line width and a predetermined thickness.

For example, the heat generator 360 is produced as below. Silver (Ag) or silver-palladium (AgPd) and glass powder and the like are mixed into paste. The paste coats the base 352 by screen printing or the like. Thereafter, the base 352 is subject to firing. For example, the heat generator 360 has a resistance value of 10Ω at an ambient temperature. Alternatively, the heat generator 360 may be made of a resistive material such as a silver alloy (AgPt) and ruthenium oxide ($RuO_2$).

A thin overcoat layer or the insulating layer 370 covers a surface of each of the heat generator 360 and the feeders 369*a*, 369*b*, and 369*c*. The insulating layer 370 attains insulation between the fixing belt 310 and the heat generator 360 and between the fixing belt 310 and the feeders 369*a*, 369*b*, and 369*c* while facilitating sliding of the fixing belt 310 over the insulating layer 370.

For example, the insulating layer 370 is made of heat resistant glass and has a thickness of 75 micrometers. The heat generator 360 heats the fixing belt 310 that contacts the insulating layer 370 by conduction of heat, increasing the temperature of the fixing belt 310 so that the fixing belt 310 heats and fixes the unfixed toner image on the sheet P conveyed through the fixing nip SN.

A description is provided of a construction of a power supply circuit for supplying power to the heater 350.

Figure 5:
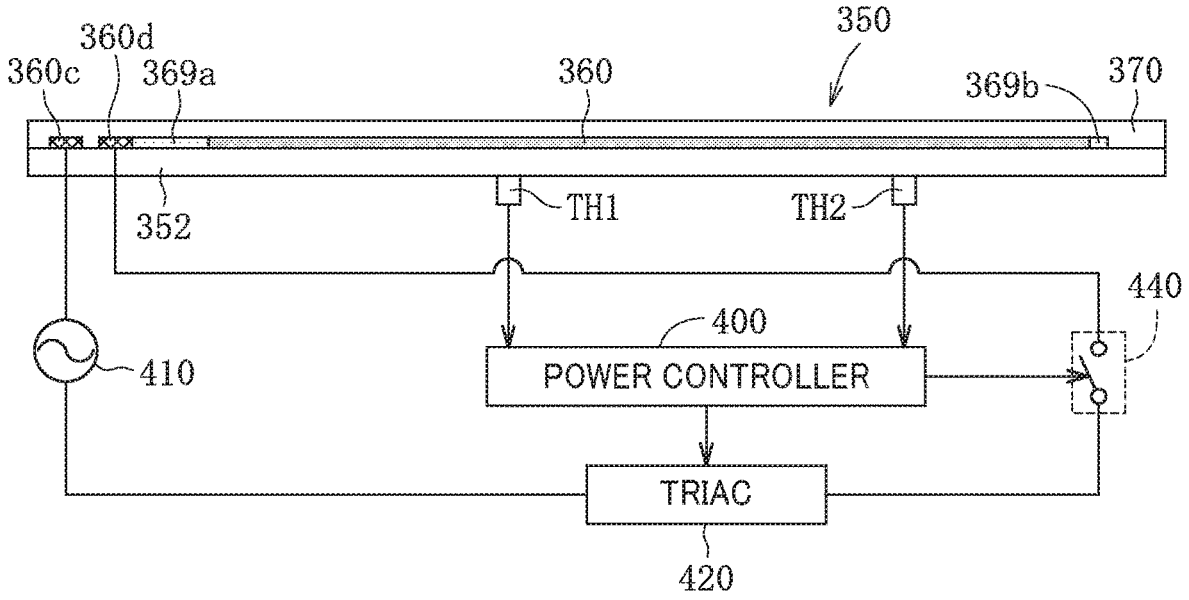
FIG. 5 is a diagram of the heater depicted in FIG. 4A, illustrating a power supply circuit and a power controller that are connected to the heater.

FIG. 5 illustrates the power supply circuit that supplies power to the heater 350. FIG. 5 illustrates the power supply circuit situated below the heater 350. The power supply circuit supplies power to the heat generator 360.

The power supply circuit includes a power controller 400 serving as a power controlling member, the alternating current power supply 410, a triac 420, and a heater relay 440. The alternating current power supply 410, the triac 420, and the heater relay 440 are connected in series and disposed between the electrodes 360*c* and 360*d*. The power controller 400 includes a microcomputer that includes a central processing unit (CPU), a read-only memory (ROM), a random access memory (RAM), and an input-output (I/O) interface.

Temperatures $T_4$ and $T_8$ detected by the first temperature sensor TH1 and the second temperature sensor TH2, respectively, are input to the power controller 400. Based on the temperature $T_4$ sent from the first temperature sensor TH1, the power controller 400 performs duty control with the triac 420 on an electric current supplied to the electrodes 360*c* and 360*d* so that the heat generator 360 attains a predetermined target temperature.

For example, with a duty cycle based on a difference between the current temperature $T_4$ sent from the first temperature sensor TH1 and the target temperature, the power controller 400 causes the triac 420 to perform duty control on the electric current that flows through the heat generator 360. The electric current is zero at a duty cycle of 0%. The electric current is maximum at a duty cycle of 100%. When a sheet P is conveyed through the fixing device 300, for example, the power controller 400 supplies supplemental power properly by considering an amount of heat conducted to the sheet P in addition to the current temperature $T_4$ sent from the first temperature sensor TH1, thus adjusting the temperature of the fixing belt 310 to a desired temperature.

A description is provided of embodiments of the present disclosure.

The heater 350 described above is attached to the heater holder 340 mounting the guide ribs 340*a* and 340*b* as illustrated in FIG. 3A. The heater holder 340 mounting the heater 350 is installed in the fixing device 300 depicted in FIG. 2A and the fixing belt 310 rotates. The pressure roller 320 drives and rotates the fixing belt 310 while the guide ribs 340*a* and 340*b* guide the fixing belt 310. The heater 350 heats the fixing belt 310 that rotates.

Figure 6:
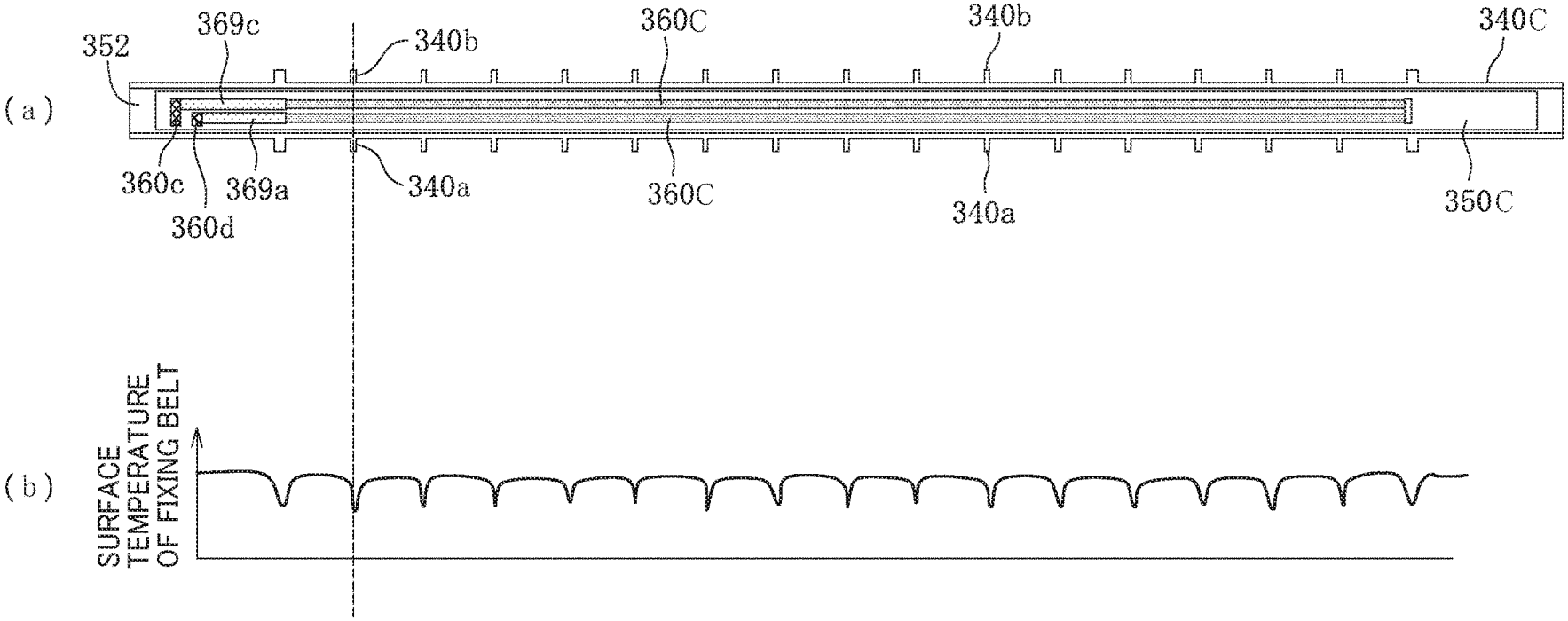
FIG. 6 is a plan view of the heater and the heater holder depicted in FIG. 3E for describing temperature decrease of a surface of the fixing belt, illustrating a graph indicating the surface temperature of the fixing belt.

Section (b) of FIG. 6 illustrates a surface temperature of the fixing belt 310 that is heated by the heater 350C while the fixing belt 310 rotates. The surface temperature of the fixing belt 310 decreases at both lateral end portions thereof, that are disposed opposite both lateral end portions of the heater 350C in a longitudinal direction thereof. Additionally, the surface temperature of the fixing belt 310 decreases at a plurality of positions in a middle portion thereof, that is disposed opposite a middle portion of the heater 350C in the longitudinal direction thereof. Temperature decrease occurs as the guide ribs 340*a* and 340*b* draw heat from the fixing belt 310 that slides over the guide ribs 340*a* and 340*b*. Temperature-decrease portions, that is, the lateral end portions and the middle portion, of the fixing belt 310, which suffer from temperature decrease are disposed opposite the guide ribs 340*a* and 340*b* precisely or substantially precisely. Even if the temperature-decease portions of the fixing belt 310 are shifted from the guide ribs 340*a* and 340*b* in a shift amount in some degree, the shift amount is an error caused by skew or the like of the fixing belt 310 and therefore slight.

A description is provided of a configuration of the heater 350 and the heater holder 340 according to a first embodiment of the present disclosure.

Figure 7A:
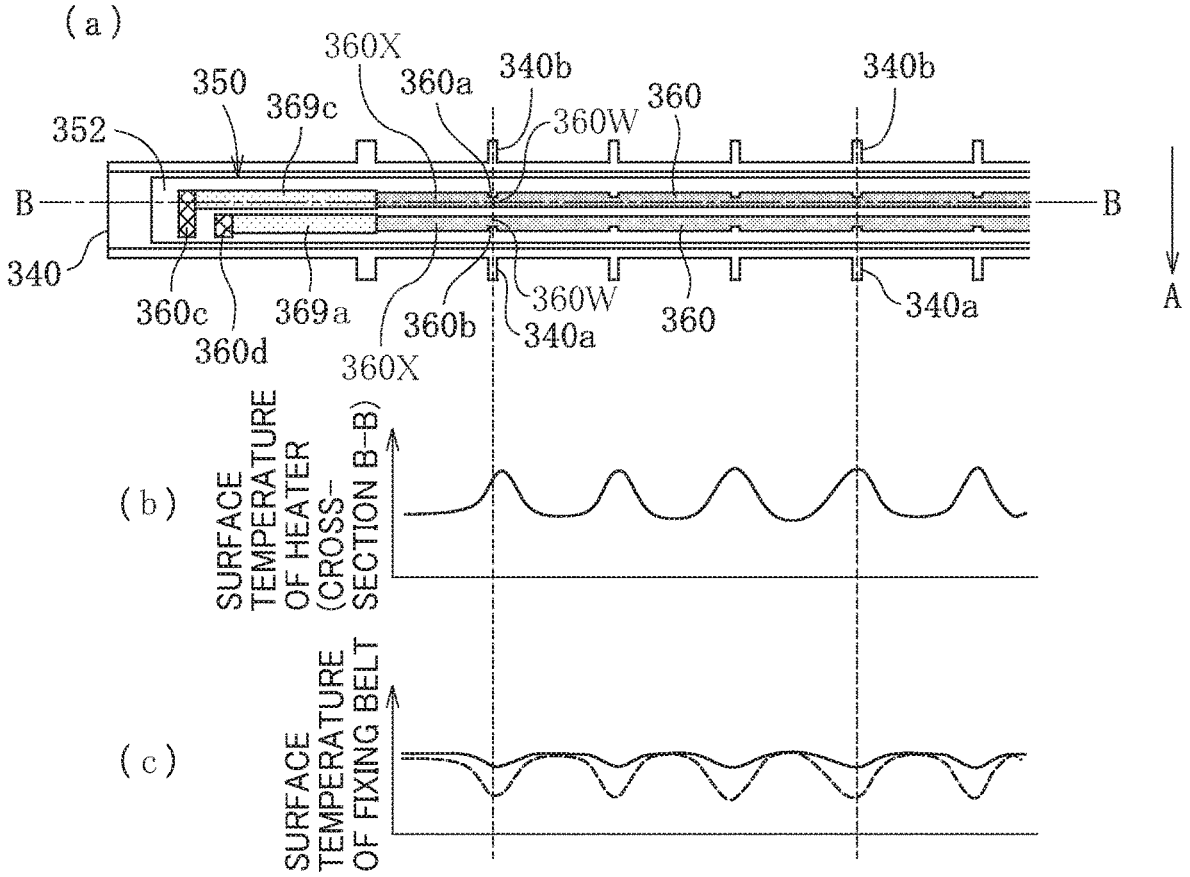
FIG. 7A is a plan view of the heater and the heater holder according to a first embodiment of the present disclosure, that is incorporated in the fixing device depicted in FIG. 2A, illustrating the heater and the heater holder in section (a), a graph indicating the surface temperature of the heater in section (b), and a graph indicating the surface temperature of the fixing belt in section (c)
Figure 7B:
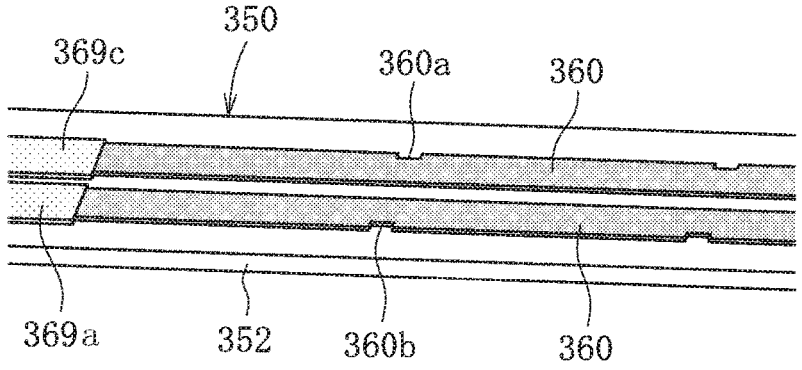
FIG. 7B is an enlarged perspective view of a heat generator of the heater depicted in FIG. 7A.

To address the above-described circumstance, according to the first embodiment of the present disclosure, the line width of the heat generator 360 decreases locally in a region that corresponds to or is disposed opposite each of the guide ribs 340*a* and 340*b* as illustrated in section (a) in FIG. 7A. FIG. 7B is an enlarged perspective view of the heat generator 360. For example, the recess 360*a* is disposed opposite the guide rib 340*b* and the recess 360*b* is disposed opposite the guide rib 340*a*. Each of the recesses 360*a* and 360*b* is rectangular.

Each of the recesses 360*a* and 360*b* decreases the line width of a recessed portion of the heat generator 360 to about a two thirds, for example, of other portion of the heat generator 360, thus producing a decreased width portion 360W (e.g., a narrow width portion) that is smaller than a basic width portion 360X of the heat generator 360 as illustrated in FIG. 7A. The basic width portion 360X serves as a primary heat generating portion of the heat generator 360. The decreased width portion 360W serves as a secondary heat generating portion of the heat generator 360. Accordingly, the power conduction resistance of the decreased width portion 360W increases by about 50% compared to other portion of the heat generator 360, that is, the basic width portion 360X. Consequently, the current density of the decreased width portion 360W increases and the heat generation amount of heat generated by the decreased width portion 360W increases by about 50%.

The recesses 360*a* are arranged with an interval (e.g., a pitch) between adjacent ones of the recesses 360*a* in a longitudinal direction of the heat generator 360. The interval between the recesses 360*a* is equivalent to the interval between the guide ribs 340*b*. The recesses 360*b* are arranged with an interval (e.g., a pitch) between adjacent ones of the recesses 360*b* in the longitudinal direction of the heat generator 360. The interval between the recesses 360*b* is equivalent to the interval between the guide ribs 340*a*. The surface temperature of the heater 350 on a cross-section B-B in section (a) in FIG. 7A defines a waveform having high temperature peaks that generate at a predetermined interval as illustrated in section (b) in FIG. 7A. Section (c) in FIG. 7A illustrates the surface temperature of the fixing belt 310. A dotted line in section (c) in FIG. 7A indicates a waveform defined by the surface temperature of the fixing belt 310 depicted in section (b) in FIG. 6. A solid line in section (c) in FIG. 7A indicates a waveform defined by the surface temperature of the fixing belt 310, that is attained by increase in the heat generation amount caused by the decreased width portion 360W. The surface temperature of the fixing belt 310 is measured with a thermo viewer at a vicinity of an entry to the fixing nip SN in the rotation direction of the fixing belt 310.

As illustrated in section (c) in FIG. 7A with the waveform defined by the surface temperature of the fixing belt 310, local increase in the heat generation amount caused by the decreased width portion 360W of the heater 350 offsets decrease in the surface temperature of the fixing belt 310, thus substantially eliminating variation in the surface temperature of the fixing belt 310 in the longitudinal direction, that is, the axial direction, of the fixing belt 310. Accordingly, the surface temperature of the fixing belt 310 is even in the longitudinal direction thereof. Thus, the heater 350 prevents failure such as faulty fixing and variation in gloss of a toner image formed on a sheet P. In a test in which a toner image is formed on an A4 size sheet in portrait orientation available as RICOH My paper with the waveform defined by the surface temperature of the fixing belt 310 depicted in section (c) in FIG. 7A, a toner image is formed on the sheet properly.

As illustrated in FIG. 4B, the line width of the heat generator 360C of the heater 350C as the comparative example is even and constant in a longitudinal direction of the heat generator 360C. Accordingly, the heat generation amount of the heat generator 360C is even in any region thereof in the longitudinal direction. Hence, if an amount of heat drawn from the fixing belt 310 is even in the longitudinal direction thereof, the temperature of the heater 350C and the fixing belt 310 that has passed through the fixing nip SN is constant, preventing faulty fixing and variation in gloss of the toner image formed on the sheet P. However, as described above, as the inner circumferential surface of the fixing belt 310 contacting the guide ribs 340*a* and 340*b* slides over the guide ribs 340*a* and 340*b*, the guide ribs 340*a* and 340*b* draw heat from the fixing belt 310. Accordingly, local temperature decrease may occur at slide portions of the fixing belt 310 where the fixing belt 310 slides over the guide ribs 340*a* and 340*b*, resulting in faulty fixing and the like.

A description is provided of a construction of a comparative fixing device.

The comparative fixing device includes two types of guide ribs arranged in a rotation direction of a fixing belt to suppress temperature decrease in a longitudinal direction of a heater. The guide ribs do not overlap each other in the longitudinal direction of the heater or a contact face of the guide rib has a recess to decrease the area where the guide rib contacts the fixing belt, thus reducing uneven temperature of the fixing belt.

However, such configuration may not prevent local temperature decrease of the fixing belt and therefore may not prevent uneven temperature of the fixing belt sufficiently. For example, immediately after the heater heats the fixing belt from a room temperature to a target temperature, the guide ribs are susceptible to low temperatures and variation in temperature. Hence, even if the contact area where the guide rib contacts the fixing belt decreases, the comparative fixing device may not prevent faulty fixing and variation in gloss of a toner image formed on a sheet.

If the guide rib is processed to have the recess to reduce the contact area where the guide rib contacts the fixing belt, the guide rib may be complicated in structure, increasing manufacturing costs of a mold. If the two types of guide ribs are arranged in the rotation direction of the fixing belt, identical parts may not be used, increasing the number of parts and manufacturing costs.

As illustrated in FIG. 7A, each of the recesses 360*a* and 360*b* is disposed on one end of the heat generator 360 in a short direction thereof. Alternatively, each of the recesses 360*a* and 360*b* may be disposed on both ends of the heat generator 360 in the short direction thereof. As illustrated in FIG. 7A, the recess 360*a* is disposed on an upstream face of the heat generator 360. Conversely, the recess 360*b* is disposed on a downstream face, that is opposite the upstream face, of the heat generator 360 in a rotation direction A of the fixing belt 310. Alternatively, as illustrated in FIG. 4A, the recesses 360*a* and 360*b* may be disposed on faces directed in an identical direction, respectively. A short direction width of each of the recesses 360*a* and 360*b* in the short direction of the heat generator 360 or a longitudinal direction width of each of the recesses 360*a* and 360*b* in the longitudinal direction of the heat generator 360 may increase or decrease properly to address a temperature decrease span generated by the guide ribs 340*a* and 340*b*.

A description is provided of a configuration of a heater 350S and a heater holder 340S according to a second embodiment of the present disclosure.

Figure 8A:
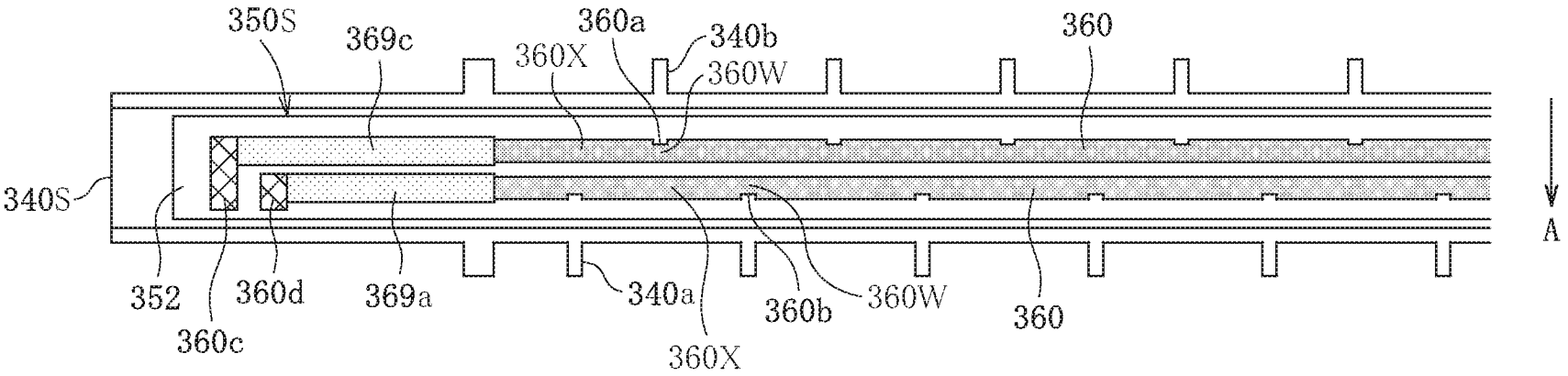
FIG. 8A is a plan view of a heater and a heater holder according to a second embodiment of the present disclosure, that are installable in the fixing device depicted in FIG. 2A.

FIG. 8A illustrates the second embodiment in which the guide rib 340*b* disposed upstream from the fixing nip SN in the rotation direction A of the fixing belt 310 is shifted from the guide rib 340*a* disposed downstream from the fixing nip SN in the rotation direction A of the fixing belt 310 in the longitudinal direction of the heat generator 360. For example, the guide ribs 340*a* and 340*b* are staggered in a longitudinal direction of the heater holder 340S, improving stability in rotation of the fixing belt 310. The recesses 360*a* and 360*b* are also staggered such that the recesses 360*a* and 360*b* are disposed opposite the guide ribs 340*b* and 340*a*, respectively.

The fixing belt 310 rotates in the rotation direction A downward in FIGS. 7A and 8A. Accordingly, the fixing belt 310 slides over the guide rib 340*b* (e.g., an upper guide rib in FIGS. 7A and 8A), that is disposed upstream from the fixing nip SN in the rotation direction A of the fixing belt 310 and is disposed in proximity to the entry to the fixing nip SN, with a great force. The fixing belt 310 slides over the guide rib 340*a* (e.g., a lower guide rib in FIGS. 7A and 8A), that is disposed downstream from the fixing nip SN in the rotation direction A of the fixing belt 310 and is disposed in proximity to an exit of the fixing nip SN, with a small force smaller than the great force. Consequently, the upstream guide rib 340*b* draws more heat from the fixing belt 310. Hence, the upstream recess 360*a* may be greater than the downstream recess 360*b* so that the decreased width portion 360W defined by the recess 360*a* generates more heat.

A description is provided of a configuration of a heater 350T and a heater holder 340T according to a third embodiment of the present disclosure.

Figure 8B:
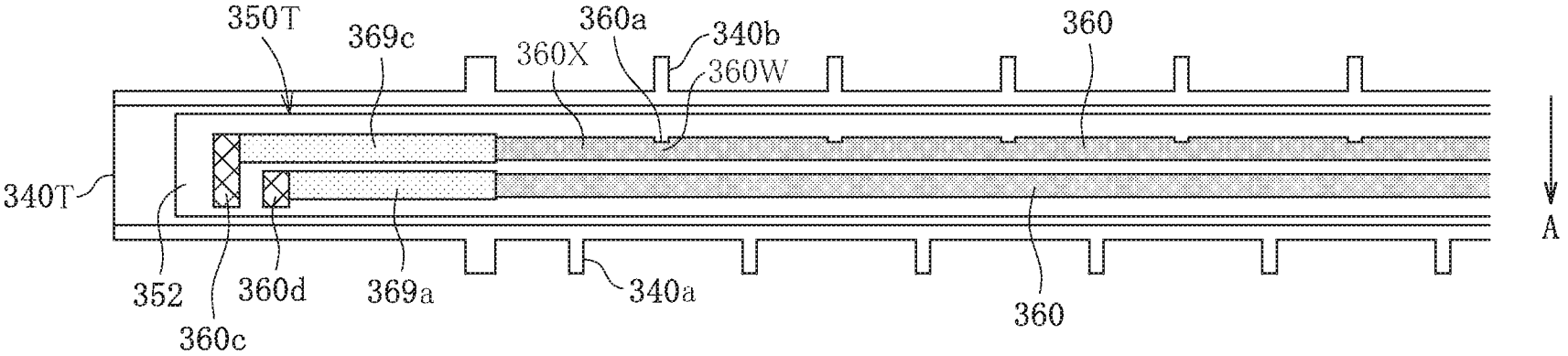
FIG. 8B is a plan view of a heater and a heater holder according to a third embodiment of the present disclosure, that are installable in the fixing device depicted in FIG. 2A.

FIG. 8B is a plan view of the heater 350T and heater holder 340T according to the third embodiment of the present disclosure. According to the third embodiment, like the second embodiment, the guide ribs 340*a* and 340*b* are staggered in the longitudinal direction of the heat generator 360. The downstream guide rib 340*a* disposed downstream from the fixing nip SN in the rotation direction A of the fixing belt 310 draws less heat from the fixing belt 310 compared to the upstream guide rib 340*b* as described above, restricting faulty fixing and variation in gloss of a toner image formed on a sheet P.

Accordingly, as illustrated in FIG. 8B, the recess 360*a* is disposed opposite the upstream guide rib 340*b*. Practically, the recess 360*a* decreases variation in temperature of the fixing belt 310 sufficiently. The recess 360*b* disposed opposite the downstream guide rib 340*a* is omitted.

The recess 360*a* depicted in FIG. 8B may be disposed in the downstream heat generator 360, that is, the lower heat generator 360 depicted in FIG. 8B. However, the recess 360*a* is preferably disposed in the upstream heat generator 360, that is, the upper heat generator 360 depicted in FIG. 8B. The decreased width portion 360W disposed in proximity to the entry to the fixing nip SN generates more heat, eliminating variation in temperature of the fixing belt 310 quickly.

A description is provided of a configuration of a heater 350U and a heater holder 340U according to a fourth embodiment of the present disclosure.

Figure 9A:
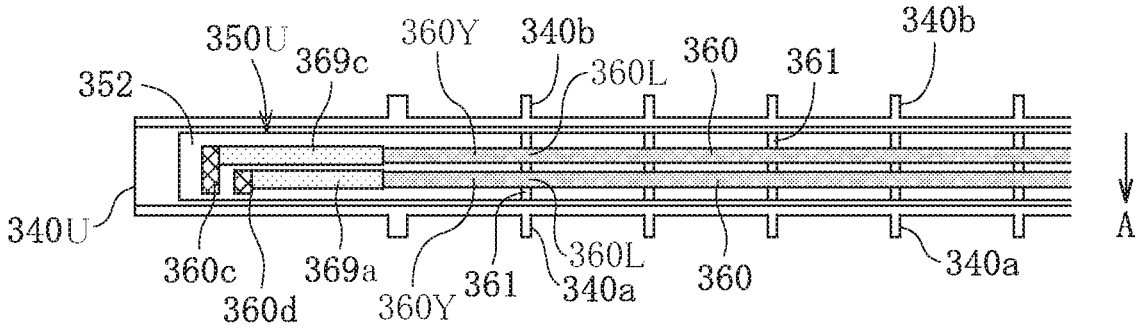
FIG. 9A is a plan view of a heater and a heater holder according to a fourth embodiment of the present disclosure, that are installable in the fixing device depicted in FIG. 2A.
Figure 9B:
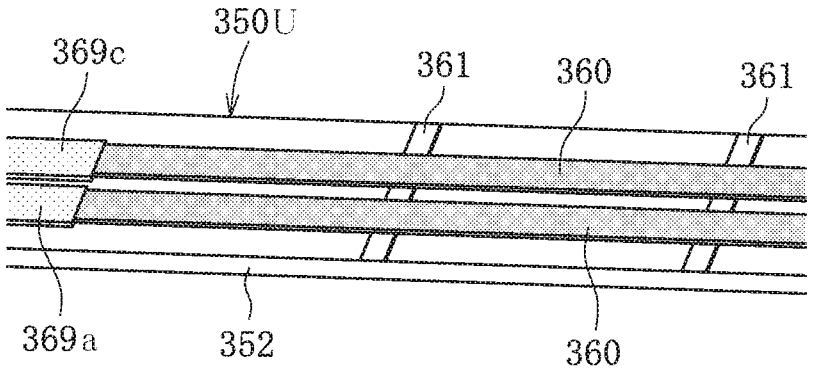
FIG. 9B is an enlarged perspective view of the heat generator of the heater depicted in FIG. 9A.

FIG. 9A is a plan view of the heater 350U and the heater holder 340U according to the fourth embodiment of the present disclosure. FIG. 9B is an enlarged perspective view of the heat generator 360 of the heater 350U. A thickness of an opposed portion of the heat generator 360, that is disposed opposite the guide rib 340*a* or 340*b*, is decreased. For example, the thickness of the opposed portion of the heat generator 360 is smaller than a thickness of other portion (e.g., a basic thickness portion 360Y) of the heat generator 360. Thus, the opposed portion of the heat generator 360 serves as a decreased thickness portion 360L, (e.g., a thin layer portion) that has the thickness smaller than the thickness of other portion, that is, the basic thickness portion 360Y, of the heat generator 360. The basic thickness portion 360Y serves as the primary heat generating portion of the heat generator 360 and the decreased thickness portion 360L serves as the secondary heat generating portion of the heat generator 360.

The decreased thickness portion 360L is produced as below. An insulator 361 as a dummy pattern made of glass or the like coats the base 352 in advance by printing. The heat generator 360 is disposed on the insulator 361 by wiring. The heat generator 360 is produced on the insulator 361 by printing to define a uniform thickness. Thus, the film thickness of the heat generator 360 disposed on the insulator 361 decreases locally. Accordingly, the power conduction resistance of an insulator abutting portion, that is, the decreased thickness portion 360L, of the heat generator 360, that is disposed on the insulator 361, increases. Consequently, the current density of the decreased thickness portion 360L of the heat generator 360 increases and the heat generation amount of heat generated by the decreased thickness portion 360L increases.

A description is provided of a configuration of a heater 350V and a heater holder 340V according to a fifth embodiment of the present disclosure.

Figure 10A:
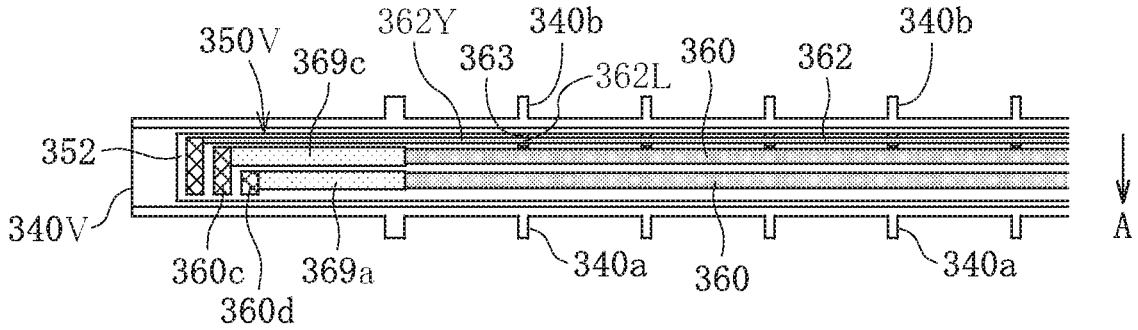
FIG. 10A is a plan view of a heater and a heater holder according to a fifth embodiment of the present disclosure, that are installable in the fixing device depicted in FIG. 2A.
Figure 10B:
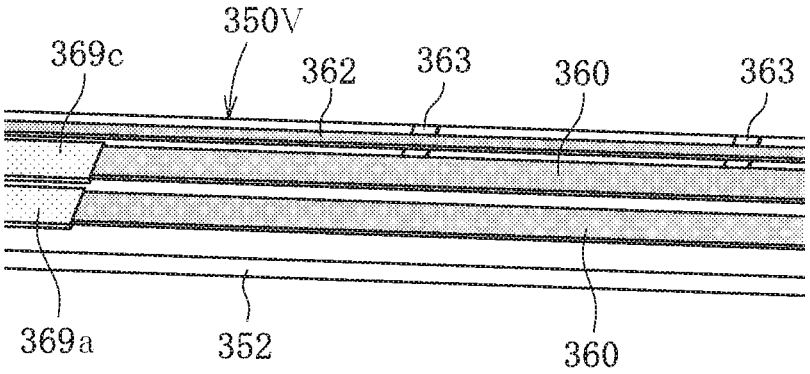
FIG. 10B is an enlarged perspective view of the heat generator of the depicted in FIG. 10A.

FIG. 10A is a plan view of the heater 350V and the heater holder 340V according to the fifth embodiment of the present disclosure. FIG. 10B is an enlarged perspective view of the heat generator 360 of the heater 350V. The heater 350V includes a supplementary heat generator 362 serving as a supplementary resistive heat generator that is wired in addition to the heat generator 360. The heat generator 362 is adjacent and parallel to the heat generator 360. The heat generator 360 serves as a primary resistive heat generator and the heat generator 362 serves as a secondary resistive heat generator or a supplementary resistive heat generator. The two heat generators 360 and 362 are supplied with power and controlled separately from each other.

The heat generator 362 is produced as below. Similarly to the insulator 361 described above with reference to FIG. 9A, an insulator 363 as a dummy pattern coats the base 352 in advance by printing. The heat generator 362 is produced on the insulator 363 to define a uniform thickness. Accordingly, a thickness (e.g., a film thickness) of an opposed portion of the heat generator 362, that is disposed opposite the insulator 363, is decreased. The thickness of the opposed portion of the heat generator 362 is smaller than a thickness of other portion (e.g., a basic thickness portion 362Y) of the heat generator 362. Thus, the opposed portion of the heat generator 362 serves as a decreased thickness portion 362L (e.g., a thin layer portion) that has the thickness smaller than the thickness of other portion of the heat generator 362. The decreased thickness portion 362L of the heat generator 362 generates more heat compared to other portion of the heat generator 362. The basic thickness portion 362Y serves as a primary heat generating portion of the heat generator 362 and the decreased thickness portion 362L serves as a secondary heat generating portion of the heat generator 362.

The heat generator 360 may not have the recesses 360*a* and 360*b* described above. Alternatively, as illustrated in FIG. 7A, in correspondence to an amount of heat drawn from the fixing belt 301 by the guide ribs 340*a* and 340*b*, the heat generator 360 may generate an increased amount of heat together with the decreased thickness portion 362L while retaining the recesses 360*a* and 360*b*.

With the two heat generators 360 and 362 illustrated in FIG. 10A, immediately after the heat generators 360 and 362 heat the fixing belt 310 from a room temperature to a target temperature, for example, the heat generator 360, serving as a primary heat generator or a resistive heat generator, and the heat generator 362, serving as a secondary heat generator or a supplementary resistive heat generator, are controlled to generate heat separately as needed, reducing variation in temperature of the fixing belt 310.

According to the embodiments described above, the width and the thickness of the heat generators 360 and 362 decrease locally at positions corresponding to or being disposed opposite the guide ribs 340*a* and 340*b*. For example, the decreased width portion 360W or the decreased thickness portion 360L or 362L defines a local portion of the heat generators 360 and 362 where the heat generators 360 and 362 generate an increased amount of heat, thus offsetting decrease in temperature of the fixing belt 310.

A description is provided of other positions of the fixing belt 301 where the fixing belt 310 is predicted to suffer from temperature decrease.

Figure 11:
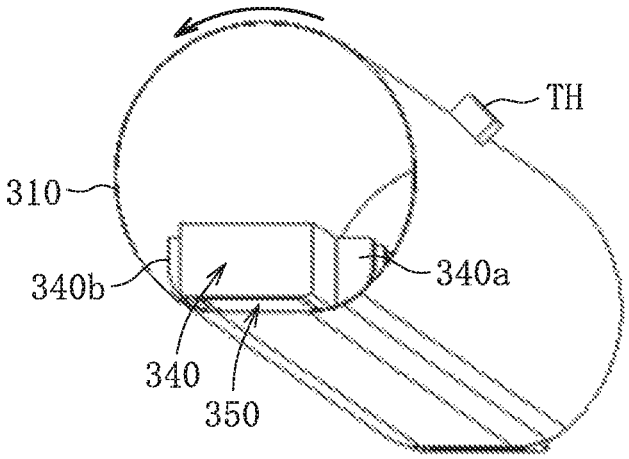
FIG. 11 is a perspective view of the fixing belt and a temperature sensor installed in the fixing device depicted in FIG. 2A.

The positions in the axial direction of the fixing belt 310 where the fixing belt 310 is predicted to suffer from temperature decrease, that define a temperature decrease span, are not limited to the guide ribs 340*a* and 340*b* described above. FIG. 11 illustrates a temperature sensor TH over which an outer circumferential surface of the fixing belt 310 slides. The temperature sensor TH that is incorporated in the heating device 91 depicted in FIG. 2A is disposed downstream from the heater 350 in the rotation direction of the fixing belt 310. The temperature sensor TH detects the temperature of the outer circumferential surface of the fixing belt 310 that slides over the temperature sensor TH. The detected temperature of the fixing belt 310 is input to the power controller 400 depicted in FIG. 5.

As the outer circumferential surface of the fixing belt 310 slides over the temperature sensor TH, the temperature sensor TH draws heat from the fixing belt 310, causing variation in temperature of the fixing belt 310. To address this circumstance, at least one of the decreased width portion 360W and the decreased thickness portions 360L and 362L of the heat generators 360 and 362 described above is disposed opposite the temperature sensor TH. At least one of the decreased width portion 360W and the decreased thickness portions 360L and 362L generates the increased amount of heat that offsets decrease in temperature of the fixing belt 310 when the temperature sensor TH draws heat from the fixing belt 310, thus preventing variation in temperature of the fixing belt 310 and resultant faulty fixing and variation in gloss of the toner image formed on the sheet P.

FIG. 11 illustrates the temperature sensor TH over which the outer circumferential surface of the fixing belt 310 slides. Alternatively, also in a configuration in which the inner circumferential surface of the fixing belt 310 slides over the second temperature sensor TH2 as illustrated in FIG. 2A, at least one of the decreased width portion 360W and the decreased thickness portions 360L and 362L may be provided similarly. At least one of the decreased width portion 360W and the decreased thickness portions 360L and 362L generates the increased amount of heat that offsets decrease in temperature of the fixing belt 310 when the second temperature sensor TH2 draws heat from the fixing belt 310, thus preventing variation in temperature of the fixing belt 310 and resultant faulty fixing and variation in gloss of the toner image formed on the sheet P.

The above describes the embodiments of the present disclosure specifically. However, the technology of the present disclosure is not limited to the embodiments described above and is modified within the scope of the present disclosure. For example, according to the embodiments described above, the heating device 91 is installed in a fixing device (e.g., the fixing devices 300, 300S, 300T, and 300U) for fixing a toner image on a sheet P. Alternatively, the heating device 91 may be applied to apparatuses and devices other than the fixing device, such as a dryer. The recesses 360*a* and 360*b* disposed in the heat generator 360 are rectangular. Alternatively, the recesses 360*a* and 360*b* may be shaped variously, for example, V-shaped or arc-shaped.

The positions in the axial direction of the fixing belt 310 where the fixing belt 310 is predicted to suffer from temperature decrease, that define the temperature decrease span, are not limited to the guide ribs 340*a* and 340*b* and the temperature sensor TH described above. For example, a separation claw and the like are employed to separate the sheet P from the fixing belt 310 stably after the sheet P passes through the fixing nip SN. The separation claw and the like may define the positions in the axial direction of the fixing belt 310 where the fixing belt 310 is predicted to suffer from temperature decrease, that is, the temperature decrease span. To address this circumstance, at least one of the decreased width portion 360W and the decreased thickness portions 360L and 362L of the heat generators 360 and 362 described above may be disposed opposite the separation claw.

A method for increasing the heat generation amount of the heat generators 360 and 362 locally is not limited to production of the decreased width portion 360W and the decreased thickness portions 360L and 362L. A wiring pattern of the heaters 350, 350S, 350T, 350U, and 350V is not limited to a straight line. The heaters 350, 350S, 350T, 350U, and 350V may include a heat generator divided into a plurality of sections in a longitudinal direction thereof. For example, each of the heaters 350, 350S, 350T, 350U, and 350V may include a plurality of heat generators that has a positive temperature coefficient (PTC) property and is electrically connected in parallel. In this case, the power controller 400 may perform duty control on the heat generators that are disposed opposite the temperature decrease span separately from each other, thus increasing the heat generation amount of the heat generators locally.

A description is provided of advantages of a heating device (e.g., the heating device 91).

As illustrated in FIG. 2A, the heating device includes a belt (e.g., the fixing belt 310) and a resistive heat generator (e.g., the heat generator 360). For example, the belt is a heating belt that heats a recording medium (e.g., a sheet P) bearing a toner image. A driver rotates the belt in a rotation direction (e.g., the rotation direction A). The resistive heat generator is disposed opposite or in contact with the belt to heat the belt. The resistive heat generator extends in an axial direction of the belt. The belt has a temperature decrease span in the axial direction of the belt, where the belt is susceptible to temperature decrease. A heat generation amount of the resistive heat generator in the temperature decrease span is greater than a heat generation amount of the resistive heat generator in an outboard span that is other than the temperature decrease span. For example, the resistive heat generator includes a primary heat generating portion (e.g., the basic width portion 360X and the basic thickness portions 360Y and 362Y) and a secondary heat generating portion (e.g., the decreased width portion 360W and the decreased thickness portions 360L and 362L). The primary heat generating portion generates heat in a first heat generation amount. The secondary heat generating portion is disposed outside the primary heat generating portion and disposed opposite the temperature decrease span of the belt. The secondary heat generating portion generates heat in a second heat generation amount that is greater than the first heat generation amount of the primary heat generating portion.

The resistive heat generator heats the belt with the greater, second heat generation amount locally in the temperature decrease span where the guide ribs 340*a* and 340*b* and the temperature sensor TH contact the belt, thus suppressing variation in temperature of the belt.

The heat generation amount of the resistive heat generator in the temperature decrease span is locally greater than the heat generation amount of the resistive heat generator in the outboard span that is other than or outboard from the temperature decrease span in the axial direction of the belt, thus suppressing variation in temperature of the belt.

According to the embodiments described above, the fixing belt 310 serves as a belt. Alternatively, a fixing film, a fixing sleeve, or the like may be used as a belt. Further, the pressure roller 320 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device comprising:

a belt configured to rotate in a rotation direction, the belt having a plurality of temperature decrease spans in an axial direction of the belt, the belt being susceptible to temperature decrease in each of the plurality of temperature decrease spans;

a plurality of guide ribs over which an inner circumferential surface of the belt slides, each of the plurality of guide ribs disposed, in the axial direction, opposite respective ones of the plurality of temperature decrease spans of the belt; and a resistive heat generator, disposed opposite the belt, configured to heat the belt, the resistive heat generator extending in the axial direction of the belt, the resistive heat generator including:

at least one primary heat generating portion configured to generate heat in a first heat generation amount; and a plurality of secondary heat generating portions, disposed outside the at least one primary heat generating portion and disposed opposite respective ones of the plurality of temperature decrease spans of the belt, to generate heat in a second heat generation amount that is greater than the first heat generation amount of the primary heat generating portion.

2. The heating device according to claim 1, wherein the at least one primary heat generating portion has a first width in the rotation direction of the belt, and wherein the plurality of secondary heat generating portions each have a second width in the rotation direction of the belt, the second width being smaller than the first width of the at least one primary heat generating portion.

3. The heating device according to claim 1, wherein the at least one primary heat generating portion has a first thickness in a direction perpendicular to the rotation direction of the belt, and wherein the plurality of secondary heat generating portions each have a second thickness in the direction perpendicular to the rotation direction of the belt, the second thickness being smaller than the first thickness of the at least one primary heat generating portion.

4. The heating device according to claim 1, wherein the plurality of guide ribs includes:

a downstream guide rib disposed downstream from the resistive heat generator in the rotation direction of the belt; and an upstream guide rib disposed upstream from the resistive heat generator in the rotation direction of the belt and disposed opposite at least one of the plurality of secondary heat generating portions of the resistive heat generator.

5. The heating device according to claim 1, further comprising:

a temperature sensor over which an outer circumferential surface of the belt slides, the temperature sensor disposed opposite at least one of the plurality of temperature decrease spans of the belt.

6. The heating device according to claim 1, further comprising:

another resistive heat generator that is controlled to generate heat separately from the resistive heat generator.

7. The heating device according to claim 6, wherein the another resistive heat generator does not include the plurality of secondary heat generating portions.

8. The heating device according to claim 1, wherein the resistive heat generator is divided into:

an upstream resistive heat generator; and a downstream resistive heat generator disposed downstream from the upstream resistive heat generator in the rotation direction of the belt.

9. The heating device according to claim 8, wherein the upstream resistive heat generator includes an upstream recess that defines the plurality of secondary heat generating portions.

10. The heating device according to claim 9, wherein the downstream resistive heat generator includes a downstream recess that defines the plurality of secondary heat generating portions.

11. The heating device according to claim 10, wherein the downstream recess is shifted from the upstream recess in the axial direction of the belt.

12. The heating device according to claim 10, wherein the upstream recess is greater than the downstream recess.

13. The heating device according to claim 1, wherein adjacent ones of the plurality of secondary heat generating portions are separated by a first interval corresponding to an interval between adjacent ones of the plurality of temperature decrease spans.

14. The heating device according to claim 1, wherein a resistance of the plurality of secondary heat generating portions is equal to at least 50% greater than a resistance of the at least one primary heat generating portion such that the second heat generation amount of the plurality of secondary heat generating portions is greater than the first heat generation amount of the primary heat generating portion.

15. A fixing device comprising:

a belt configured to rotate in a rotation direction, the belt having a plurality of temperature decrease spans in an axial direction of the belt, the belt being susceptible to temperature decrease in each of the plurality of temperature decrease spans;

a plurality of guide ribs over which an inner circumferential surface of the belt slides, each of the plurality of guide ribs disposed, in the axial direction, opposite respective ones of the plurality of temperature decrease spans of the belt;

a pressure rotator configured to press against the belt to form a fixing nip between the belt and the pressure rotator, the fixing nip through which a recording medium bearing an image is conveyed; and a resistive heat generator, disposed opposite the belt, configured to heat the belt, the resistive heat generator extending in the axial direction of the belt, the resistive heat generator including:

at least one primary heat generating portion configured to generate heat in a first heat generation amount; and a plurality of secondary heat generating portions, disposed outside the at least one primary heat generating portion and disposed opposite respective ones of the plurality of temperature decrease spans of the belt, to generate heat in a second heat generation amount that is greater than the first heat generation amount of the primary heat generating portion.

16. The fixing device according to claim 15, wherein adjacent ones of the plurality of secondary heat generating portions are separated by a first interval corresponding to an interval between adjacent ones of the plurality of temperature decrease spans.

17. The fixing device according to claim 15, wherein a resistance of the plurality of secondary heat generating portions is equal to at least 50% greater than a resistance of the at least one primary heat generating portion such that the second heat generation amount of the plurality of secondary heat generating portions is greater than the first heat generation amount of the primary heat generating portion.

18. An image forming apparatus comprising:

an image forming device configured to form an image; and a fixing device configured to fix the image on a recording medium, the fixing device including:

a belt configured to rotate in a rotation direction, the belt having a plurality of temperature decrease spans in an axial direction of the belt, the belt being susceptible to temperature decrease in each of the plurality of temperature decrease spans;

a plurality of guide ribs over which an inner circumferential surface of the belt slides, each of the plurality of guide ribs disposed, in the axial direction, opposite respective ones of the plurality of temperature decrease spans of the belt;

a pressure rotator configured to press against the belt to form a fixing nip between the belt and the pressure rotator, the fixing nip through which the recording medium bearing the image is conveyed; and a resistive heat generator, disposed opposite the belt, configured to heat the belt, the resistive heat generator extending in the axial direction of the belt, the resistive heat generator including:

at least one primary heat generating portion configured to generate heat in a first heat generation amount; and a plurality of secondary heat generating portions, disposed outside the at least one primary heat generating portion and disposed opposite respective ones of the plurality of temperature decrease spans of the belt, to generate heat in a second heat generation amount that is greater than the first heat generation amount of the primary heat generating portion.

* * * * *